US011140494B2

(12) United States Patent
Pedersen et al.

(10) Patent No.: US 11,140,494 B2
(45) Date of Patent: Oct. 5, 2021

(54) HEARING DEVICE OR SYSTEM FOR EVALUATING AND SELECTING AN EXTERNAL AUDIO SOURCE

(71) Applicant: Oticon A/S, Smørum (DK)

(72) Inventors: Michael Syskind Pedersen, Smørum (DK); Jesper Jensen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/832,980

(22) Filed: Mar. 27, 2020

(65) Prior Publication Data

US 2020/0314562 A1 Oct. 1, 2020

(30) Foreign Application Priority Data

Mar. 28, 2019 (EP) ..... 19165753

(51) Int. Cl.
*H04R 25/00* (2006.01)
*H04R 25/02* (2006.01)

(52) U.S. Cl.
CPC ..... *H04R 25/407* (2013.01); *H04R 25/02* (2013.01); *H04R 25/552* (2013.01); *H04R 25/554* (2013.01); *H04R 2430/23* (2013.01)

(58) Field of Classification Search
CPC .... H04R 25/407; H04R 25/02; H04R 25/552; H04R 25/554; H04R 2430/23
See application file for complete search history.

(56) References Cited

U.S. PATENT DOCUMENTS

| | | | | |
|---|---|---|---|---|
| 9,729,994 | B1 * | 8/2017 | Eddins | H04S 7/302 |
| 2009/0268933 | A1 | 10/2009 | Baechler | |
| 2013/0094683 | A1 | 4/2013 | Hansen | |
| 2015/0049892 | A1 | 2/2015 | Petersen et al. | |
| 2017/0180882 | A1 | 6/2017 | Lunner et al. | |
| 2018/0262849 | A1 | 9/2018 | Farmani et al. | |

FOREIGN PATENT DOCUMENTS

| | | |
|---|---|---|
| EP | 3 255 902 A1 | 12/2017 |
| EP | 3 285 500 A1 | 2/2018 |

* cited by examiner

*Primary Examiner* — Andrew L Sniezek
(74) *Attorney, Agent, or Firm* — Birch, Stewart, Kolasch & Birch, LLP

(57) ABSTRACT

A hearing system comprises a hearing device worn on the head, or fully or partially implanted in the head, of a user, and external audio transmitters. The hearing system allows wireless communication to be established between the hearing device and the audio transmitters. The hearing device comprises microphones providing respective electric input signals; a beamformer filter providing a beamformed signal from the electric input signals; and an output unit. The hearing system further comprises a selector/mixer for selecting and possibly mixing one or more of the electric input signals or the beamformed signal and external electric signals from the audio transmitters, and providing a current input sound signal based thereon for presentation to the user. The selector/mixer is controlled by a source selection processor, which determines the source selection control signal based on a comparison of the beamformed signal and the external electric sound signals or processed versions thereof.

20 Claims, 11 Drawing Sheets

HEARING DEVICE OR SYSTEM FOR EVALUATING AND SELECTING AN EXTERNAL AUDIO SOURCE

SUMMARY

The present application relates to a scheme for evaluating, selecting and utilizing the sound of an external audio source, e.g. a microphone, in a hearing device, e.g. a hearing aid, or in a hearing system comprising a hearing device. In an embodiment, the hearing system is portable (wearable), e.g. fully or partially implanted. In an embodiment an automatic method for selecting and utilizing the sound of an external microphone is provided (automatic in the sense that the user does not have to actively interact with the hearing system).

A Hearing System:

In an aspect of the present application, a hearing system is provided. The hearing system comprises

- at least one hearing device adapted for being worn on the head, or fully or partially implanted in the head, of a user, and
- a multitude of external, spatially separated, audio transmitters, each providing respective external electric sound signals comprising audio.

The hearing system is configured to allow wireless communication, including audio communication, between said hearing device and said external audio transmitters, at least from said external audio transmitters to said at least one hearing device, to be established.

The at least one hearing device may comprise

- a multitude of microphones, each providing an electric input signal representative of sound;
- a beamformer filter providing a beamformed signal from said multitude of electric input signals; and
- an output unit configured to provide stimuli perceivable by the user as sound.

The hearing system may comprise a selector/mixer for selecting and possibly mixing one or more of said electric input signals or said beamformed signal from the hearing device and said external electric signals from the audio transmitters and to provide a current input sound signal based thereon intended for being presented to the user, possibly in a further processed form, the selector/mixer being controlled by a source selection control signal provided by a source selection processor configured to determine said source selection control signal in dependence of a comparison of said beamformed signal and said external electric sound signals or processed versions thereof.

Thereby an improved hearing device may be provided.

At least two of the audio transmitters may be configured to pick up sound from a sound field surrounding the hearing device and the at least two of the audio transmitters. The hearing system may be configured to provide that sound picked up by the selected audio transmitter is transmitted to the at least one hearing device and presented to the user by the output unit, and wherein the audio transmitter, e.g. a microphone unit, is selected in dependence of the beamformed signal or a parameter related thereto. Processed versions thereof may e.g. include filtered or down-sampled versions of the respective original signals, or parameters derived therefrom, e.g. one or more of an SNR measure (e.g. a ratio of an unprocessed (noisy) microphone and an estimated noise, a modulation measure (e.g. a modulation depth), a level measure (e.g. a level estimate), etc. Parameters may e.g. be determined on a frequency sub-band level. In an embodiment, a mixing ratio between the electric input signals or the beamformed signal and the external electric sound signals is determined in dependence of a comparison of the beamformed signal with the external electric sound signals or processed versions thereof. In an embodiment, the beamformed signal is presented to the user instead of one of the external sound signals, in case its quality (e.g. an SNR measure or a speech intelligibility measure) is higher than any of the external electric sound signals.

At least a part of the wireless communication between the external audio transmitters and the hearing device may e.g. be based on Bluetooth or Bluetooth Low Energy or similar technology. At least a part of the wireless communication between the external audio transmitters and the hearing device may e.g. be based on a personal communications network protocol, e.g. IEEE 802.15.4 (ZigBee), NFC, or any other standardized or proprietary protocol.

In case of mixing a signal of the hearing device (e.g. one of the electric input signals or the beamformed signal) with one or more of the external electric sound signals, appropriate alignment processing (time delay, and/or gain (attenuation or amplification)) may be applied to the respective input audio signals (e.g. based on a similarity measure, e.g. a correlation measure).

The source selection control signal may be determined based on a comparison of filtered or down-sampled versions of the beamformed signal with filtered or down-sampled versions of the multitude of external electric sound signals.

The source selection control signal may be determined based on a comparison of parameters derived from the beamformed signal with corresponding parameters derived from the multitude of external electric sound signals. Parameters derived from the original signals may e.g. comprise one or more of an SNR-measure (e.g. a ratio of an unprocessed (noisy) microphone and an estimated noise, a modulation measure (e.g. a modulation depth), a level measure (e.g. a level estimate), etc. Parameters may e.g. be determined on a frequency sub-band level.

The hearing system may be configured to provide that the comparison is performed in the respective audio transmitters, and wherein a similarity measure indicative of the degree of similarity of the beamformed signal with the respective external electric sound signals or processed versions thereof is determined in the audio transmitters.

The similarity measures are transmitted from the multitude of audio transmitters to the at least one hearing device or to a (another selected, e.g. external) processing device in communication with the hearing device. The individual similarity measures are compared in the source selection processor and used to determine the source selection control signal. The source selection control signal selects the audio transmitter, e.g. a microphone unit, having the largest similarity measure among the (presently active) multitude of microphone units, possibly in dependence of a comparison of a quality measure (e.g. and estimated SNR) derived from the electric input signals or the beamformed signal and the external electric sound signals. In an embodiment, an external electric sound signal is only selected for presentation to the user, if its quality measure is larger than that (or those) of the electric input signals (or the beamformed signal) of the hearing device.

The hearing system may be configured to provide that the comparison is performed in the at least one hearing device (or in a processing device in communication with the at least one hearing device), and wherein respective similarity measures indicative of the degree of similarity of the beamformed signal or a processed version thereof with the respective external electric sound signals or correspondingly processed versions thereof are determined in the at least one hearing device or in the processing device.

The hearing system may be configured to provide that the beamformed signal is a target enhancing (or target maintaining) beamformer signal. 'Enhanced' may be taken to indicate 'relative to other signals', external signals.

The hearing system may be configured to provide that the at least one hearing device receives the external electric sound signal from the audio transmitter having the largest similarity measure among the multitude of audio transmitters (e.g. microphone units) and to present it to the user via the output unit. The external electric sound signal selected for presentation to the user may e.g. be mixed with the beamformed signal provided by the beamformer filter, and/or further external electric sound signals.

The hearing system may be configured to provide that the beamformed signal is a target cancelling beamformer signal and be configured to provide that the at least one hearing device receives the external electric sound signal from the audio transmitter having the smallest similarity measure among the multitude of audio transmitters and to present it to the user via the output unit.

At least one of the multitude of audio transmitters may comprise a microphone unit. The multitude of audio transmitters me be individual devices or form part of respective separate electronic devices, e.g. a cellular telephone, a TV, a speakerphone, a headset, a hearing aid, etc. The multitude of audio transmitters may comprise a multitude of microphone units, such as at least two microphone units. Each of the multitude of audio transmitters may comprise or be constituted by a microphone unit. The multitude of audio transmitters may comprise a communication device, e.g. a cellular telephone, such as a smartphone or similar wearable or portable device comprising communication capabilities, e.g. a smartwatch, or a tablet computer.

The microphone unit or at least one of the microphone units may comprise a multitude of microphones, each providing a microphone signal, and a beamformer filter, configured to provide a beamformed signal based on the microphone signals picked up by the multitude of microphones. The beamformed signal of the microphone unit(s) may constitute the external electric sound signal of the hearing system (and evaluated for similarity with the beamformed signal of the hearing device and—if selected—possibly forwarded to the hearing device for presentation to the user.

The microphone unit or units may comprise or form part of one or more of a wireless microphone unit, a mobile telephone, and a speakerphone.

The at least one hearing device may be constituted by or comprise a hearing aid, a headset, an earphone, an ear protection device or a combination thereof.

The hearing system may further comprise an auxiliary device, e.g. a processing device or a remote control device. The hearing system may be adapted to establish a communication link between the hearing device or devices and the auxiliary device to provide that information (e.g. control and status signals, possibly audio signals) can be exchanged or forwarded from one to the other. The auxiliary device may e.g. be or comprise a remote control, a smartphone, or other portable or wearable electronic device, such as a smartwatch or the like.

The auxiliary device may e.g. be or comprise a remote control for controlling functionality and operation of the hearing device(s). The function of a remote control may e.g. be implemented in a smartphone, the smartphone possibly running an APP allowing to control the functionality of the audio processing device via the smartphone (the hearing device(s) comprising an appropriate wireless interface to the smartphone, e.g. based on Bluetooth or some other standardized or proprietary scheme).

The auxiliary device may e.g. be or comprise a cellular telephone, e.g. a smartphone.

The auxiliary device may e.g. be or comprise another hearing device. In an embodiment, the hearing system comprises two hearing devices adapted to implement a binaural hearing system, e.g. a binaural hearing aid system 8 adapted to communicate with each other, e.g. wirelessly).

A Hearing Device:

In an aspect, a hearing device adapted for being worn by a user is furthermore provided. The hearing device comprises

- a multitude of microphones, each providing an electric input signal representative of a sound field;
- a beamformer filter providing a beamformed signal from the multitude of electric input signals; and
- an output unit configured to provide stimuli perceivable by the user as sound;
- a wireless transceiver for receiving a signal comprising external electric sound signals from a multitude of external audio transmitters, possibly via a processing device, and for transmitting a signal comprising data, e.g. audio data, to the multitude of audio transmitters, possibly via the processing device,
- a selector/mixer for selecting and possibly mixing one or more of the electric input signals or the beamformed signal from the hearing device and the external electric signals from the audio transmitters and to provide a current input sound signal based thereon intended for being presented to the user, possibly in a further processed form, the selector/mixer being controlled by a source selection control signal,
- a source selection processor configured to determine the source selection control signal in dependence of a comparison of the beamformed signal and the external electric sound signals or processed versions thereof.

'A processed version thereof' (e.g. parameter related thereto) may e.g. be a signal to noise ratio (SNR) or other measure of characteristics of an audio signal, e.g. a modulation measure, a speech presence probability measure, a speech intelligibility measure, etc.

The hearing device may be constituted by or comprise a hearing aid, a headset, an earphone, an ear protection device or a combination thereof.

The hearing device may be adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

The hearing device comprises an output unit for providing a stimulus perceived by the user as an acoustic signal based on a processed electric signal. In an embodiment, the output unit comprises a number of electrodes of a cochlear implant (for a CI type hearing device) or a vibrator of a bone conducting hearing device. In an embodiment, the output unit comprises an output transducer. In an embodiment, the output transducer comprises a receiver (loudspeaker) for providing the stimulus as an acoustic signal to the user (e.g. in an acoustic (air conduction based) hearing device). In an embodiment, the output transducer comprises a vibrator for providing the stimulus as mechanical vibration of a skull bone to the user (e.g. in a bone-attached or bone-anchored hearing device).

The hearing device may be configured to present the current input sound signal from the selector/mixer, or a further processed version thereof, to the user via the output unit.

The hearing device comprises an input unit for providing an electric input signal representing sound. In an embodiment, the input unit comprises an input transducer, e.g. a microphone, for converting an input sound to an electric input signal.

The hearing device may comprise a directional microphone system (beamformer filter) adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art. In hearing devices, a microphone array beamformer is often used for spatially attenuating background noise sources. Many beamformer variants can be found in literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

The hearing device comprises a wireless receiver for receiving a wireless signal comprising or representing sound and for providing an electric input signal representing said sound. The wireless receiver may e.g. be configured to receive an electromagnetic signal in the radio frequency range (3 kHz to 300 GHz). The wireless receiver may e.g. be configured to receive an electromagnetic signal in a frequency range of light (e.g. infrared light 300 GHz to 430 THz, or visible light, e.g. 430 THz to 770 THz).

The hearing device may comprise antenna and transceiver circuitry (e.g. a wireless receiver) for wirelessly receiving a direct electric input signal from another device, e.g. from a microphone unit (comprising a wireless microphone), or from an entertainment device (e.g. a TV-set), a communication device, or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by antenna and transceiver circuitry of the hearing device can be of any type. In an embodiment, the wireless link is established between two devices, e.g. between an entertainment device (e.g. a TV) and the hearing device, or between two hearing devices, e.g. via a third, intermediate device (e.g. a processing device, such as a remote control device, a smartphone, etc.). In an embodiment, the wireless link is used under power constraints, e.g. in that the hearing device is or comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation), etc.

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

The hearing device and/or the communication device may comprise an electrically small antenna. An 'electrically small antenna' is in the present context taken to mean that the spatial extension of the antenna (e.g. the maximum physical dimension in any direction) is much smaller than the wavelength $\lambda_{Tx}$ of the transmitted electric signal. In an embodiment, the spatial extension of the antenna is a factor of 10, or 50 or 100 or more, or a factor of 1 000 or more, smaller than the carrier wavelength $\lambda_{Tx}$ of the transmitted signal. In an embodiment, the hearing device is a relatively small device. The term 'a relatively small device' is in the present context taken to mean a device whose maximum physical dimension (and thus of an antenna for providing a wireless interface to the device) is smaller than 10 cm, such as smaller than 5 cm. In an embodiment 'a relatively small device' is a device whose maximum physical dimension is much smaller (e.g. more than 3 times, such as more than 10 times smaller, such as more than 20 times small) than the operating wavelength of a wireless interface to which the antenna is intended (ideally an antenna for radiation of electromagnetic waves at a given frequency should be larger than or equal to half the wavelength of the radiated waves at that frequency). At 860 MHz, the wavelength in vacuum is around 35 cm. At 2.4 GHz, the wavelength in vacuum is around 12 cm. In an embodiment, the hearing device has a maximum outer dimension of the order of 0.15 m (e.g. a handheld mobile telephone). In an embodiment, the hearing device has a maximum outer dimension of the order of 0.08 m (e.g. a headset). In an embodiment, the hearing device has a maximum outer dimension of the order of 0.04 m (e.g. a hearing instrument).

The hearing device may form part of or constitute a portable device, e.g. a device comprising a local energy source, e.g. a battery, e.g. a rechargeable battery.

The hearing device may comprise a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

The hearing device may comprise an analogue-to-digital (AD) converter to digitize an analogue input (e.g. from an input transducer, such as a microphone) with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the input unit, and or the antenna and transceiver circuitry comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

The hearing device may be configured to operate in different modes, e.g. a normal mode and one or more specific modes, e.g. selectable by a user, or automatically selectable. A mode of operation may be optimized to a specific acoustic situation or environment. A mode of operation may include a low-power mode, where functionality of the hearing device is reduced (e.g. to save power), e.g. to disable wireless communication, and/or to disable specific features of the hearing device.

The hearing device may comprise a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

The hearing device may comprise a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device further comprises other relevant functionality for the application in question, e.g. compression, noise reduction, feedback control, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof. In an embodiment, the hearing assistance system comprises a speakerphone (comprising a number of input transducers and a number of output transducers, e.g. for use in an audio conference situation), e.g. comprising a beamformer filtering unit, e.g. providing multiple beamforming capabilities.

Use:

In an aspect, use of a hearing device as described above, in the 'detailed description of embodiments' and in the claims, is moreover provided. In an embodiment, use is provided in a system comprising audio distribution. In an embodiment, use is provided in a system comprising one or more hearing aids (e.g. hearing instruments), headsets, ear phones, active ear protection systems, etc., e.g. in handsfree telephone systems, teleconferencing systems (e.g. including a speakerphone), public address systems, karaoke systems, classroom amplification systems, etc.

A Method:

In an aspect, a method of operating a hearing system is furthermore provided by the present application. The hearing system comprises at least one hearing device, e.g. a hearing aid or hearing aids, adapted for being worn by a user, and a multitude of external, spatially separated, audio transmitters, e.g. microphone units, said audio transmitters being individual devices or forming part of respective separate electronic devices, e.g. communication devices, providing respective external electric sound signals. The method comprises providing a multitude of external electric sound signals from said multitude of audio transmitters;

providing wireless communication, including audio communication, between said at least one hearing device and said external audio transmitters, at least from said audio transmitters to said at least one hearing device;

providing a multitude of electric input signals, each being representative of a sound field at said at least one hearing device;

providing a beamformed signal from said multitude of electric input signals; and providing stimuli perceivable by the user as sound;

providing a source selection control signal in dependence of a comparison of said beamformed signal and said external electric sound signals or processed versions thereof; and selecting and possibly mixing one or more of said electric input signals or said beamformed signal from the hearing device and said external electric signals from the audio transmitters to thereby provide a current input sound signal based thereon in dependence of said source selection control signal, said current input signal being intended for presentation to the user, possibly in a further processed form.

It is intended that some or all of the structural features of the system or device described above, in the 'detailed description of embodiments' or in the claims can be combined with embodiments of the method, when appropriately substituted by a corresponding process and vice versa. Embodiments of the method have the same advantages as the corresponding systems or devices.

In case a given external electric sound signal is being selected for presentation to the user, the method further comprises providing that sound provided by said selected audio transmitter is transmitted to said at least one hearing device and presented to the user by said output unit.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions:

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve). In an embodiment, the hearing device comprises a speakerphone (comprising a number of input transducers and a number of output transducers, e.g. for use in an audio conference situation).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. smartphones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as hearing aids, headsets, active ear protection devices, headphones, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids.

Figure 1:
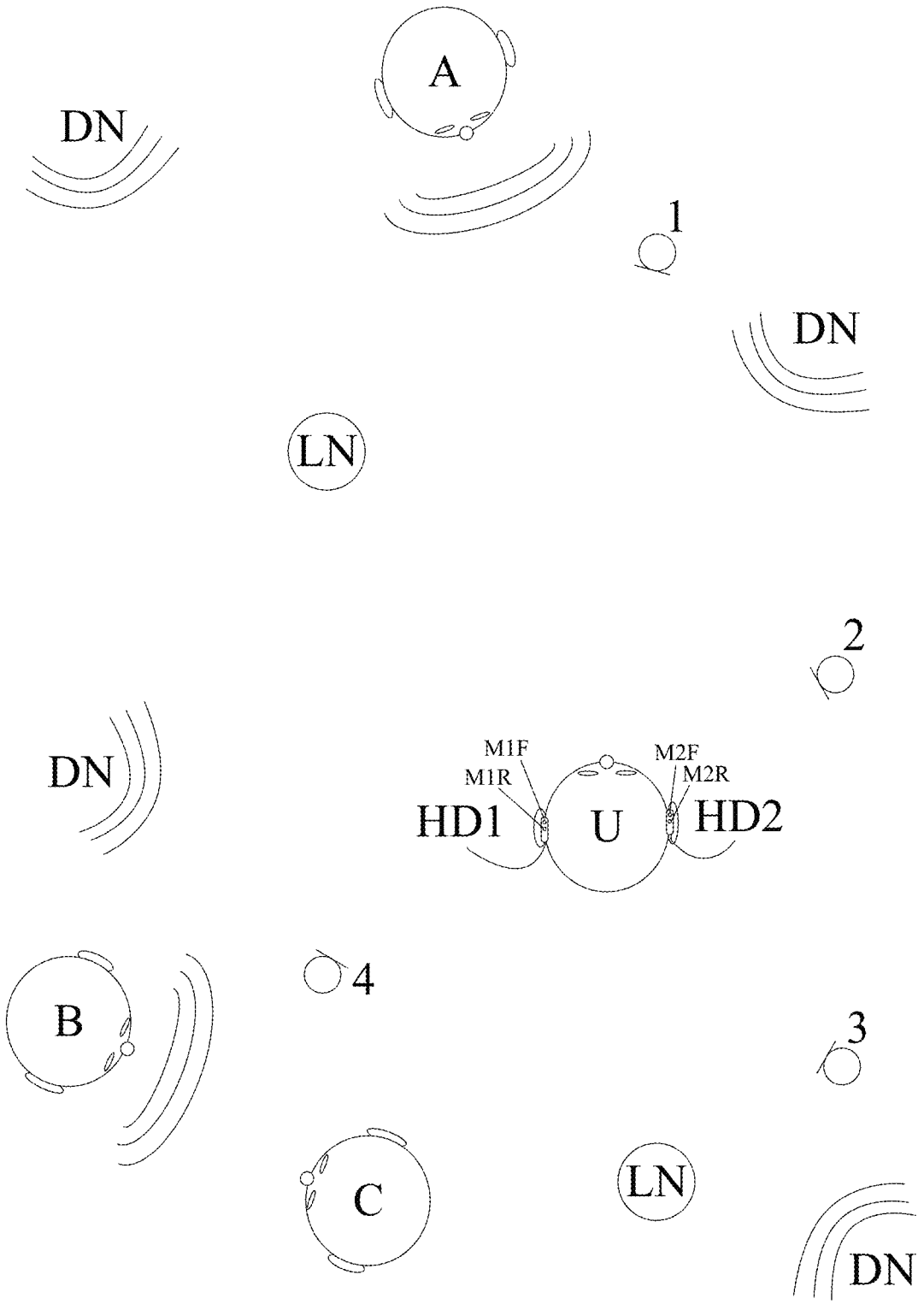
FIG. 1 shows an exemplary scenario wherein a person wearing hearing instruments (at left and right ears), which are connected (preferable wirelessly) to a grid of (generally randomly distributed) available external microphone units, is located in a room with a one or more sound sources (e.g. talking persons), and one or more noise sources.

FIG. 1 shows an exemplary scenario wherein a person wearing hearing instruments (at left and right ears), which are connected (preferable wirelessly) to a grid of (generally randomly distributed) available external microphone units, is located in a room with a one or more sound sources (e.g. talking persons), and one or more noise sources. In noisy situations, e.g. where multiple persons are talking simultaneously (and further where one or more noise sources are present), it may be advantageous to listen to the sound of one of the available external microphones rather than the sound picked up by the hearing instrument as the signal to noise ratio of the target sound picked up by the external microphones may be much higher compared to the signal to noise ratio available at the microphones located in the hearing instrument(s).

FIG. 1 schematically shows person (U) wearing hearing instruments (HD1, HD2) located in a room together with a number (here three) of persons (A, B, C), which may be simultaneously or sequentially talking. One or more sound sources may be present, as indicated by localized sound (LS) or diffuse sound sources (DN), e.g. reverberation. Besides the hearing instruments (HD1, HD2), each comprising a number of microphones (here two (M1F, M1R) and (M2F, M2R), respectively), a number of external microphones (1, 2, 3, 4) are available. It could e.g. be microphones located in different mobile phones, which potentially could be made available for the hearing instrument user via a wireless connection between the external device and the hearing instrument(s) (HD1, HD2). Alternatively, the wireless microphones (1, 2, 3, 4) could be part of an "enhanced-communication-package" provided by the hearing aid manufacturer. In noisy conditions, such external microphones (1, 2, 3, 4) may be of benefit for the hearing instrument user (U) as the quality (e.g. in terms of signal to noise ratio (SNR)) of the target sound from target sound source (A) picked up by some of the microphones may (1, 2, 3, 4) be better than what may be achieved solely by the microphones ((M1F, M1R), (M2F, M2R)) built into the hearing instrument (HD1, HD2). Utilizing a dynamic external microphone array may be challenging for several reasons:

- The number of available external microphones (here four) may vary over time. It is assumed that the hearing instrument(s) (HD1, HD2) is(are) able to connect to available external microphones (1, 2, 3, 4).
- The location of the available microphones (1, 2, 3, 4) relative to the target source candidates (A, B, C) and the hearing aid (U) user may be changing over time, and is generally unknown.
- The sample rate of the different external microphones (1, 2, 3, 4) may be different from each other as well as different from the sample rate of the hearing instrument(s) (HD1, HD2). Even if the sample rates were similar, the sample time of the different units would not (necessarily) be synchronized.
- The transmission bandwidth is limited. It may not be possible to exchange all microphone signals simultaneously. It may thus be required to select between the external microphones (1, 2, 3, 4) in order to ensure that the most relevant signal is transmitted to the hearing instrument(s) (HD1, HD2). In one embodiment, a particular wireless device may physically contain several microphones, e.g. two or more, and combine the microphone signals into a single output signal (a beamformed signal), which may then potentially be transmitted to the hearing aid user (U).
- Different simultaneous talkers (in FIG. 1: A, B), e.g., a target talker (for the user U) and a 'competing talker', may be picked up by the external microphone array. A strategy for selecting the target talker from a pool of several target talker candidates is needed. While many manual selection schemes may be envisioned, a selection scheme which does not require the user's active (conscious) involvement is aimed at.
- The external microphones (1, 2, 3, 4) may have different, unknown processing and transmission latency. This, combined with the fact that the sample rate and the microphone's location are unknown, and the transmission bandwidth is generally limited, makes it practically challenging to combine the signals (e.g., in a beamformer stage at the hearing instrument(s) (HD1, HD2)) in order to improve the signal to noise ratio. In an embodiment, the external microphones may be shared between several hearing instrument users, i.e. each microphone may simultaneously be part of several networks.

In the example of FIG. 1, the user wears first and second hearing devices, e.g. hearing aids, in or at left and right ears, respectively, each hearing device comprising two microphones (allowing beamformed signals to be generated in each hearing device, individually (based on local microphone signals), and/or binaurally (based on microphone signals from left and right ears)). In other scenarios, the user may wear first and second hearing devices in or at left and right ears, respectively, each hearing device comprising only one microphone (allowing beamformed signals to be generated based on microphone signals from left and right ears). In yet another scenario, the user may wear a single hearing device comprising two or more microphones (allowing beamformed signals to be generated in the hearing device based on (local) microphone signals of the hearing device).

The present application discloses a method for selecting an external microphone signal among multiple microphone signals based on the user's head orientation (or alternatively a target direction identified by the hearing instrument). We assume that the user selects the signal of interest based on the direction of the head (nose). The idea is sketched in FIG. 2.

Figure 2:
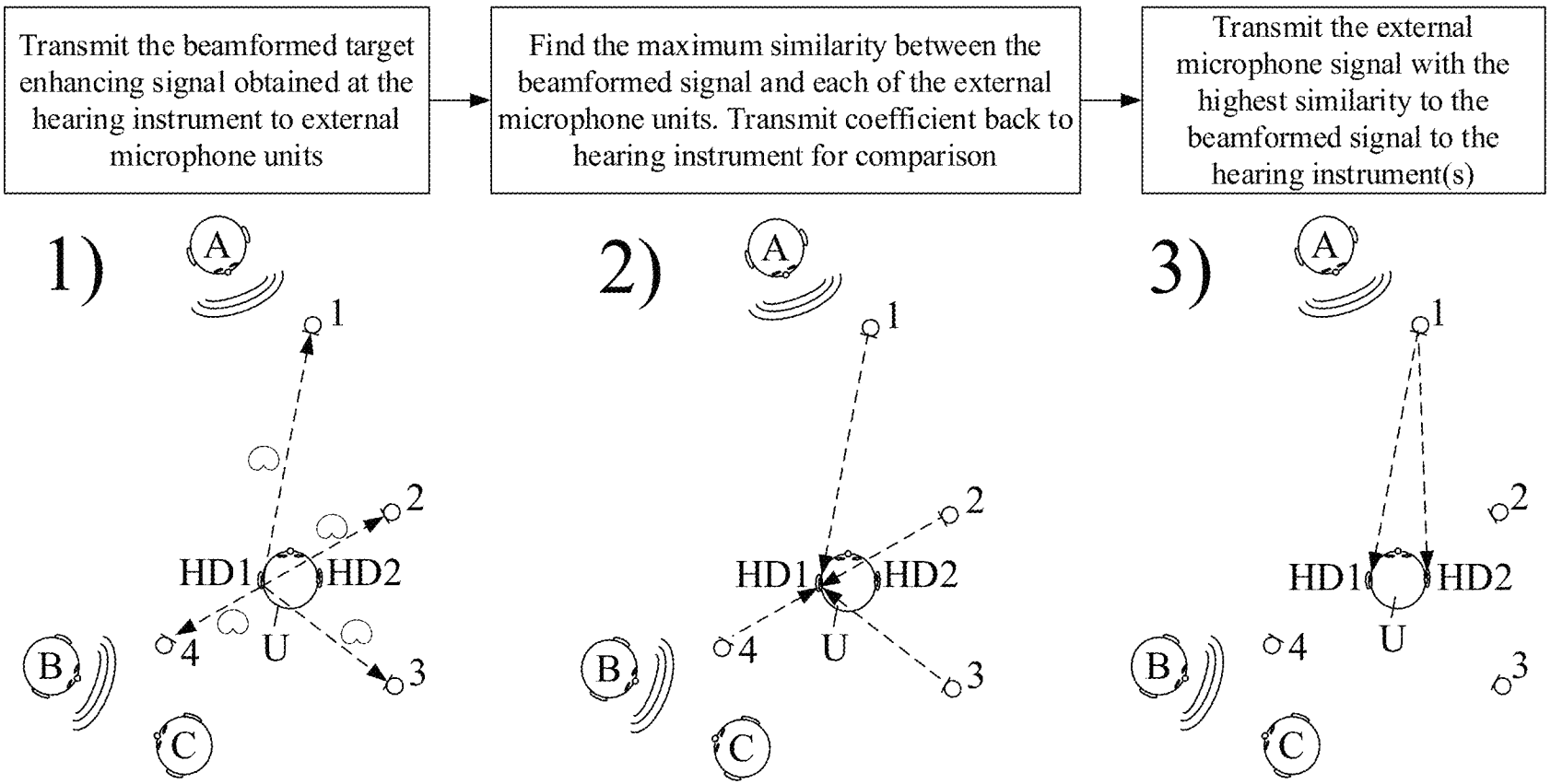
FIG. 2 illustrates an embodiment of a method of operating of a hearing system according to the present disclosure, wherein a beamformed signal comprising the target signal provided by one of the hearing instruments of the hearing system is transmitted to the external microphone units for evaluation.

FIG. 2 shows an embodiment of a method of operating of a hearing system according to the present disclosure, wherein a beamformed signal comprising the target signal provided by one of the hearing instruments of the hearing system is transmitted to the external microphone units for evaluation. The leftmost part of FIG. 2, denoted '1)' illustrates the transmission of a beamformed target enhancing signal obtained at one (HD1, as shown, or both (HD1, HD2)) of the hearing instrument(s) to the external microphone units (1, 2, 3, 4) currently present (and available to the hearing system) in the environment of the user (U). The beamformed signal enhances signals from the front of the user (U) while signals from the back are attenuated. The beamformed signal is illustrated in FIG. 2 by the heart-formed, cardioid-shaped directional pattern. The middle part of FIG. 2, denoted '2)' illustrates an estimation of a similarity coefficient (e.g. correlation) between the beamformed signal and each of the external microphone signals. The coefficients are determined in each of the microphone units (or in devices, which the microphone units form part of) and transmitted back to the hearing instrument (HD1) for comparison. The external microphone unit exhibiting the maximum similarity coefficient is identified in the hearing instrument (HD1). The hearing instrument (HD1) informs each external microphone unit (1, 2, 3, 4), which of the microphone units that has been selected. In bandwidth constrained scenarios, the selected external microphone unit sends its microphone signal to the hearing instrument (HD1), while the other microphone units do not. In bandwidth-rich scenarios, on the other hand, each external microphone unit may send its microphone signal to the hearing instrument (HD1) (e.g. continuously and simultaneously); and a selection of the microphone signal(s) of current interest to the hearing device user may be performed in the hearing instrument; and the hearing instrument may play back the selected microphone signal(s) to the user via loudspeaker(s) of the hearing instrument(s) (e.g. a combination of the microphone signals may be played, e.g. based on probabilities of matching with the beamformed signal of the hearing instrument). The rightmost part of FIG. 2, denoted '3)' illustrates that the external microphone unit (1) having the microphone signal with the highest similarity to the beamformed signal is transmitted to the hearing instrument(s) (HD1, HD2). Thereby a version of the current target sound signal having an improved quality (e.g. signal to noise ratio) is received by the hearing instrument(s) and played for the user (possibly mixed with a (possibly attenuated) signal picked up by hearing aid microphone(s) to give a sense of the acoustic environment of the user).

The beamformed signal may be created using any one of the range of beamforming techniques known in the literature, e.g. MVDR (minimum Variance Distortionless Response) or MWF (Multichannel Wiener Filtering) beamformers, steered in a pre-defined direction, e.g. straight-ahead of the listener/hearing device user.

As the signal of main interest is assumed to generally be in front of the hearing instrument user (U), the hearing instrument microphones (e.g. (M1F, M1R) in FIG. 1) are combined in such a way that a directional (beamformed) signal is obtained, wherein the front (target) direction is enhanced while noise from other directions is suppressed. This beamformed, target enhanced, signal may be based on microphones ((M1F, M1R) (M2F, M2R)) from either the left hearing instrument (HD1) or the right hearing instrument (HD2), or a combination of microphones from both hearing instruments (M1F, M1R, M2F, M2R) in binaural configurations. The hearing instrument may as well be or comprise a microphone array attached to the head e.g. via a headband or a cap or the like, or built into the frame of a pair of glasses. The beamformed signal may be based on a fixed beamformer or an adaptive beamformer (e.g. where noise is adaptively attenuated). The beamformed signal may have a fixed target direction (such as the front direction) or an adaptive target direction estimated by the hearing instrument. Even though the noise in this beamformed signal has been reduced, one of the external microphones may contain an even more noise-free realization of the target signal. In the exemplary scenario of FIG. 2, the beamformed, target-enhanced, signal is transmitted from the hearing instrument to each of the external microphone units (1, 2, 3, 4), cf. '1)' in FIG. 2. Within each external microphone unit, the similarity between the external microphone signal and the received target enhanced beamformed signal may be estimated. The similarity may e.g. be estimated using one or more of many known similarity measures, e.g. in terms of the correlation between the two signals, e.g. the cross-correlation (e.g. a short-term correlation), a coherence, an average, or . . . . The external microphone signal containing the highest similarity with the received target enhancing signal is transmitted back to the hearing instrument in order to be presented to the listener, cf. '3)' in FIG. 2. In order to compare similarity scores, the external devices may exchange and compare their scores (the information rate exchanged between devices, however, may be very small, as this only needs to happen a few times a second). Each external microphone unit may then compare its local similarity scores and initiate signal transmission to the hearing device(s) according to a selected criterion, e.g. to transmit the signal of a given microphone unit having the largest similarity score, or the signals of those microphone units, e.g. two or three, having the largest scores, e.g. if the score is larger than a minimum threshold. Alternatively, the individual similarity scores of the microphone units may be transmitted back to the hearing instrument (HD1), cf. '2)' in FIG. 2, or to another processing device in communication with the hearing instrument, for comparison there (see e.g. FIG. 3). The 'comparing device' may subsequently inform the external microphone units, which of them is(are) (presently) selected for transmitting their audio signal to the hearing device(s).

Alternatively, the similarity scores may not be compared at all (or this option may be a default option, in case of limited bandwidth or link options), and the audio signal of a given microphone unit is transmitted to the hearing device, if its similarity score exceeds a threshold value (e.g. 0.5 for score having values between 0 and 1).

FIG. 2 illustrates a method of operating a hearing system comprising steps 1), 2), 3):

1) Transmit the beamformed target enhancing signal obtained at the hearing instrument to external microphone units;

2) Find the maximum similarity between the beamformed signal and each of the external microphone units. Transmit coefficient back to hearing instrument for comparison;

3) Inform the external microphone units about the decision (who is(are) selected);

4) Transmit the external microphone signal with the highest similarity to the beamformed signal to the hearing instrument(s).

Figure 3:
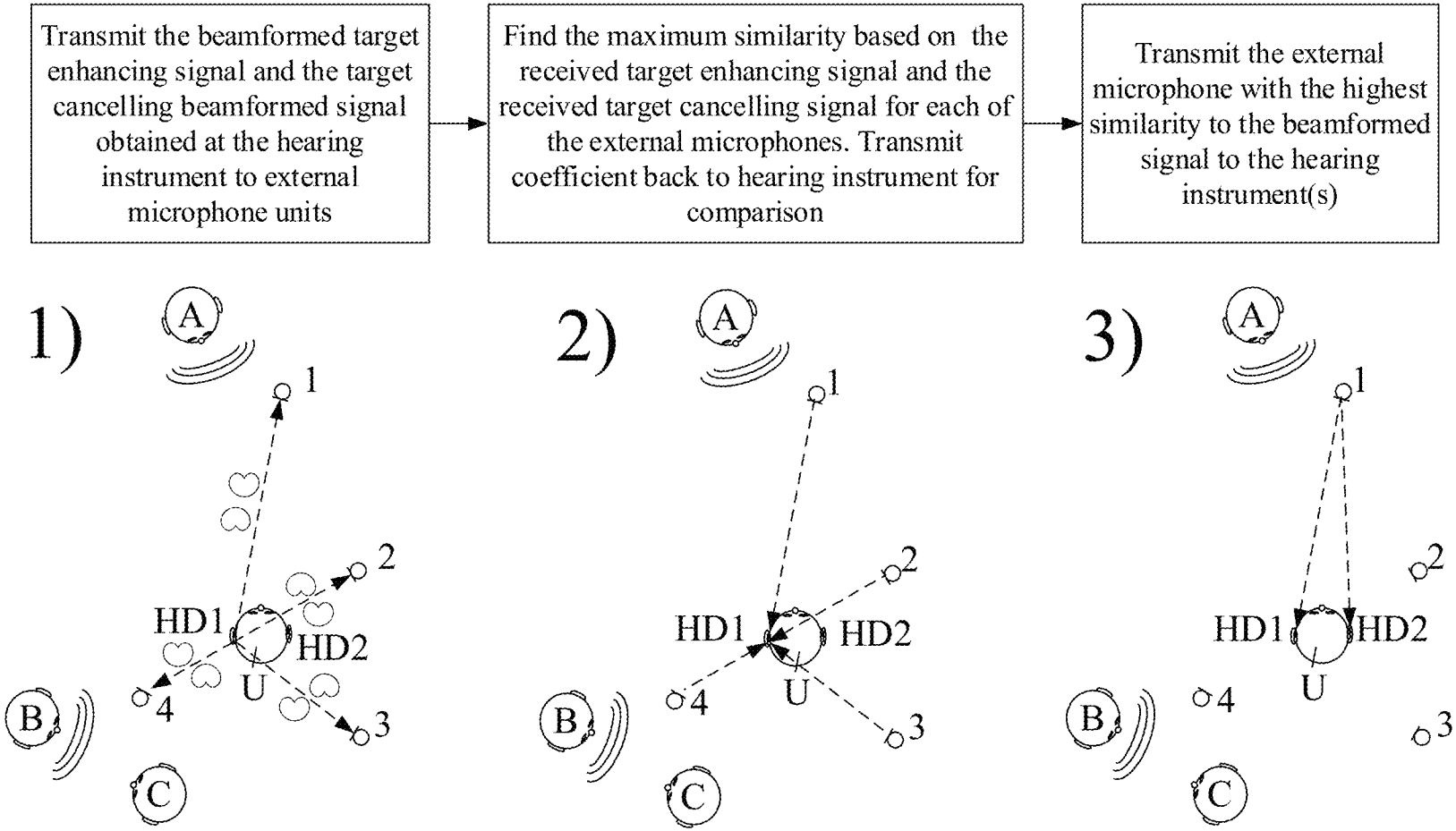
FIG. 3 shows an embodiment a method of operating of a hearing system according to the present disclosure, wherein two beamformed signals, one comprising the target signal, the other not comprising the target signal, provided by one of the hearing instruments of the hearing system are transmitted to the external microphone units for evaluation.

As an alternative or in addition to calculating and transmitting the target enhancing beamformer signal, the hearing instrument may calculate and transmit a target cancelling beamformer signal, as shown in FIG. 3.

FIG. 3 shows an embodiment a method of operating of a hearing system according to the present disclosure, wherein two beamformed signals, one comprising the target signal, the other not comprising the target signal, provided by one of the hearing instruments of the hearing system are transmitted to the external microphone units for evaluation. As an alternative to or in addition to transmitting a beamformed signal wherein the target signal is enhanced (as shown in FIG. 2), a target cancelling beamformer signal may, as shown in FIG. 3, be transmitted to the external microphone(s). The two directional signals are illustrated by the cardioid-shaped patterns pointing towards and away from the target direction in front of the listener (U). Where a target enhancing signal is expected to be highly correlated with a microphone close to the target talker (here talker A, external microphone 1), the target cancelling beamformer (with target absent) is expected to be less correlated to an external microphone signal mainly containing the target talker. The similarity measure may thus be measured as a ratio between the target enhancing beamformer signal ($y_{tgt}$) correlated with the external microphone signal (here $x_1$) and the target cancelling beamformer signal ($y_{tgtcncl}$) correlated with external microphone signal ($x_1$). We may thus base our similarity measure of the n'th external microphone unit as the ratio between two correlation coefficients, i.e.

$$sim_n = \frac{\rho(x_n, y_{tgt})}{\rho(x_n, y_{tgtcncl})},$$

where $\rho(x_n, y_{tgt})$ is the correlation coefficient (the maximum correlation value, possibly averaged across time) between the n'th external microphone signal $x_n$ and the target enhancing beamformer signal $y_{tgt}$ and similarly, $\rho(x_n, y_{tgtcncl})$ is the correlation between the n'th external microphone signal and the target cancelling beamformer signal $y_{tgtcncl}$. In an alternative embodiment, the similarity measure sim is dependent only on the correlation ρ of the external microphone signal with the target enhancing beamformer signal $\rho(x_n, y_{tgt})$ or only with the target cancelling beamformer signal $\rho(x_n, y_{tgtcncl})$.

FIG. 3 illustrates a method of operating a hearing system comprising steps 1), 2), 3):

1) Transmit the beamformed target enhancing signal and the target cancelling beamformed signal obtained at the hearing instrument to external microphone units;

2) Find the maximum similarity based on the received target enhancing signal and the received target cancelling signal for each of the external microphones. Transmit coefficient back to hearing instrument (or other processing device) for comparison;

3) Inform the external microphone units about the decision (who is(are) selected);

4) Transmit the external microphone with the highest similarity to the beamformed signal to the hearing instrument(s).

Figure 4:
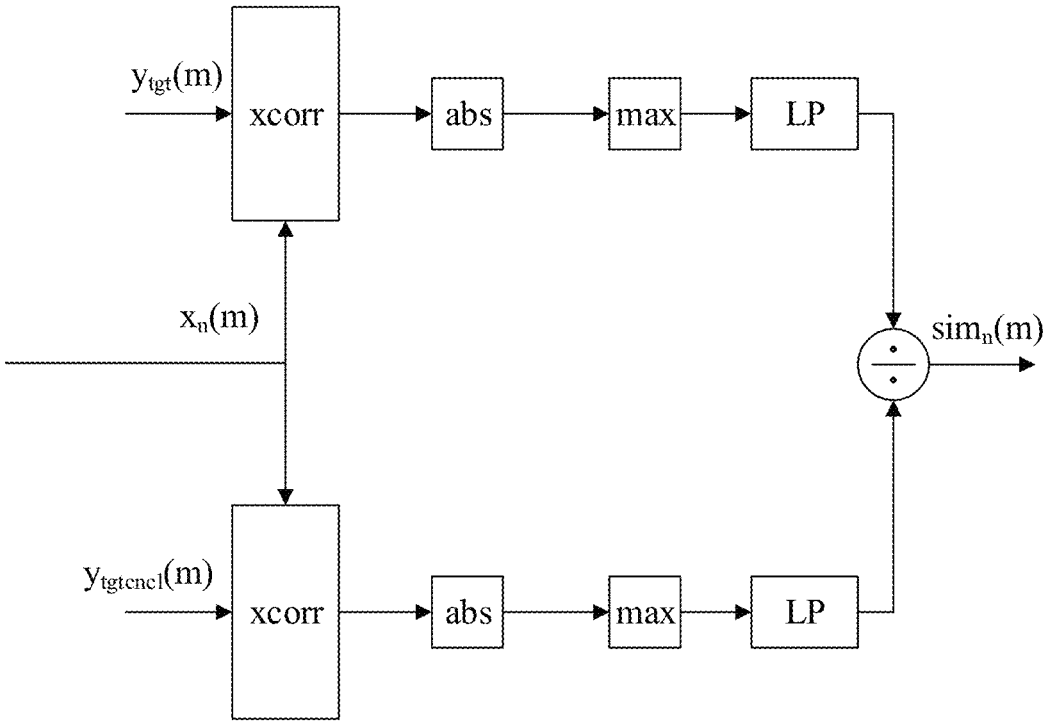
FIG. 4 shows a first exemplary implementation of the similarity measure.
Figure 5:
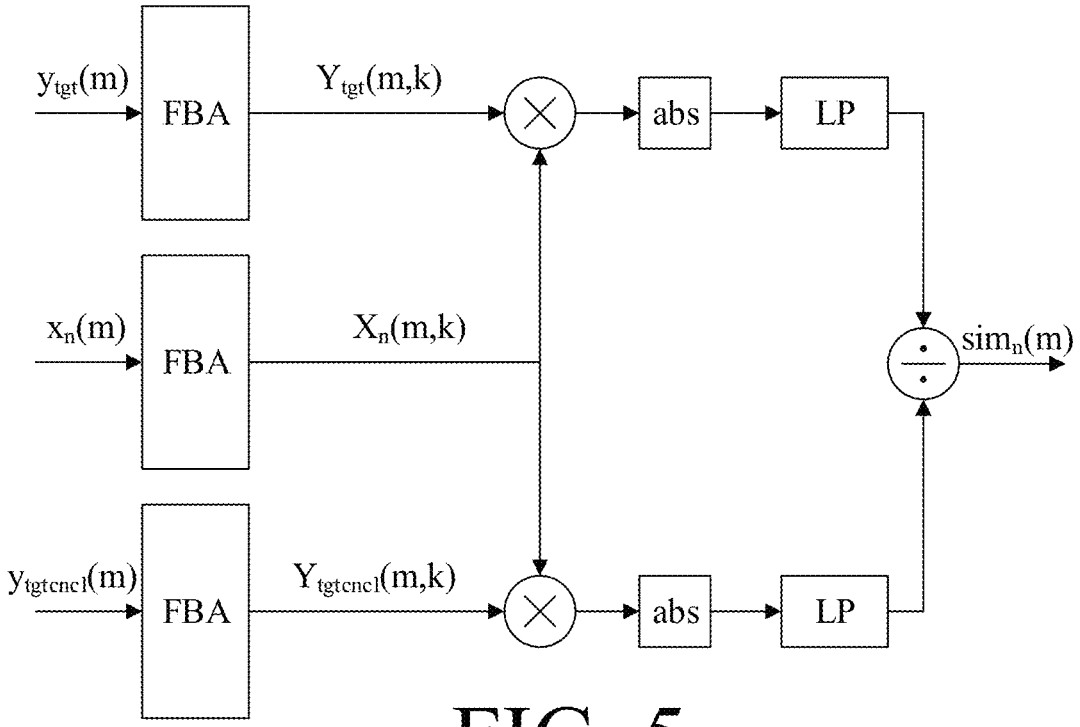
FIG. 5 shows a second exemplary implementation of the similarity measure.

Different examples of possible implementations of the similarity measure are illustrated in FIG. 4 and FIG. 5.

FIG. 4 shows a first exemplary implementation of the similarity measure. Given the m'th time frame of the different input signals ($x_n$, $y_{tgt}$ and $y_{tgtcncl}$), the cross-correlation is calculated (cf. units xcorrr). It is important that the frame length $T_F$ of the signals is sufficiently long in order to take different possible latencies of the input signals into account as the latency of each of the external microphones is not necessarily known. The frame length $T_F$ may e.g. be 50 milliseconds. The maximum cross-correlation value is found (cf. units abs and max) and possibly low-pass filtered (cf. unit LP) (and possibly down-sampled) before the ratio $sim_n(m)$ between the maximum cross-correlation values is calculated (cf. unit ÷) for the m'th signal frame, where m is a (time) frame index.

FIG. 5 shows a second exemplary implementation of the similarity measure. The implementation of the similarity measure of FIG. 5 is in the frequency domain. The m'th frame of the time domain signals ($x_n$, $y_{tgt}$ and $y_{tgtcncl}$) is converted into the frequency domain, e.g. by a short-time Fourier transform implemented by use of the fast Fourier transform (cf. respective analysis filter bank units (FBA)) providing respective frequency domain (sub-band) signals $Y_{tgt}(m,k)$, $X_n(m,k)$ and $Y_{tgtcncl}(m,k)$, where m and k are time and frequency indices, respectively. It is important that the frame length of the signals is sufficiently long in order to take different possible latency of the input signals into account. The frame length may e.g. be 50 milliseconds. In each frequency channel (defined by frequency index k), the magnitude (cf. unit abs) or squared magnitude (cf. unit $|abs|^2$) of the products ($X_n*Y_{tgt}$ and $X_n*Y_{tgtcncl}$, or the products $|x_n|\cdot|y_{tgt}|$and $|x_n|\cdot|y_{tgtcncl}|$, cf. multiplication units 'X') are calculated and possibly low-pass (LP) filtered (cf. units LP), and possibly followed by a down-sampling, before the ratio $sim_n(m)$ between the values is calculated (cf. unit ÷). Alternatively, the similarity measure may be based on $\rho(x_n, y_{tgt})$ or $\rho(x_n, y_{tgtcncl})$. The cross correlation may e.g. be calculated in terms of Pearson's correlation coefficient.

Pearson's (sample) correlation coefficient may be written as $$\rho(x, y) = \frac{\frac{1}{N}\sum_{i=1}^{N}(x_i - \mu_x)(y_i - \mu_y)}{\sqrt{\frac{1}{N}\sum_{i=1}^{N}(x_i - \mu_x)^2}\sqrt{\frac{1}{N}\sum_{i=1}^{N}(y_i - \mu_y)^2}}$$

Where represent the two signals x and y that are to be correlated and $x_i$ and $y_i$ are specific samples thereof (at time index i), $\mu_x$, $\mu_y$ are average values of x and y and N is a time range (number of time frames considered). Samples $x_i$ and $y_i$ (and thus ρ) may be frequency dependent (e.g. via frequency index k). The time range represented by N is dependent on the dynamics of the acoustic environment. Preferably N is selected as a compromise between stability of the correlation measure (N should be sufficiently long to not react to fast changing, temporary situations, and sufficiently short to not delay adaptation to (sudden but) more stable changes to the acoustic environment). As an alternative to the sum over N samples a recursive average could be calculated using first order IIR filters.

In addition to (or instead of) measuring the similarity using correlation between the audio signals, other similarity measures may be used. For example, the estimated SNR of the target enhanced beamformer signal may be compared to the estimated SNR of the external microphones. In an embodiment, only if the SNR of the external microphone signal ($X_n$) is higher than the SNR of the beamformed signal ($Y_{tgt}$) of the hearing device, the external microphone signal ($X_n$) is transmitted to (or received by) the hearing device and presented to the listener.

In the case of one hearing instrument on each ear (cf. e.g. HD1, HD2 in FIG. 1-3), a target enhanced signal may be available from the local processing at each hearing instrument. In order to save communication bandwidth, it is preferable that only one of the target enhanced signals is transmitted. One way of selecting which of the target enhanced signals to be transmitted is to estimate the local signal to noise ratio at each hearing instrument. Such a signal to noise ratio may e.g. be based on the modulation depth of the audio signals. Based on a comparison between the estimated signal-to-noise ratios, preferably the target-enhanced signal containing the highest estimated signal to noise ratio should be transmitted to the external microphone units (cf. e.g. 1, 2, 3, 4 in FIG. 1-3).

An external microphone unit may consist of one or more microphones (e.g. a microphone array). The external microphone signal may be a directional signal, or an omnidirectional signal obtained by a combination of the microphones within the external microphone unit. The external microphone unit may be or form part of a mobile phone such as a smartphone. The external microphone unit may run an application capable of calculating the necessary steps in order to determine if the external microphone signal shall be presented to the listener. Such a step may be finding the similarity between the external microphone signal and the received signals from the hearing instrument.

In order to save power and reduce the amount of bandwidth needed for transmitting the signal from the hearing instrument, the transmitted microphone signal may be low-pass filtered and down-sampled, e.g. to a sample rate of 1000 Hz or 2000 Hz or 4000 Hz or 8000 Hz. Alternatively, the signals may be transmitted in frequency bands. In an embodiment, the signal is transformed into the frequency domain before it is transmitted. In one embodiment only the amplitude (magnitude) response of the signal is transmitted such that the similarity measure is based on comparison between amplitude responses. In one embodiment, temporal envelopes extracted from selected frequency sub-bands are transmitted—the advantage of this is that the envelope signals can be down-sampled significantly, in order to reduce the information needed to be transmitted Similarity measures based on envelope fidelity may then be used at the wireless device (microphone unit).

In an embodiment, the received external microphone signal is 'binauralized' based on the estimated direction of arrival (DOA) before presented to the listener (e.g. by applying appropriate head related transfer functions (HRTF) for the estimated DOA to the signal received from the external microphone unit before presenting the signals at the respective left and right hearing instruments, see e.g. US2013094683A1).

An advantage of the present invention is that not all microphone signals need to be transmitted/exchanged.

In the shown preferred embodiment some calculations are performed in the external microphone units while other calculations take place in the hearing instrument. It is obvious that the calculations as well may take place in other units. E.g., all calculations may take place in the hearing instrument, as illustrated in FIG. 6.

Figure 6:
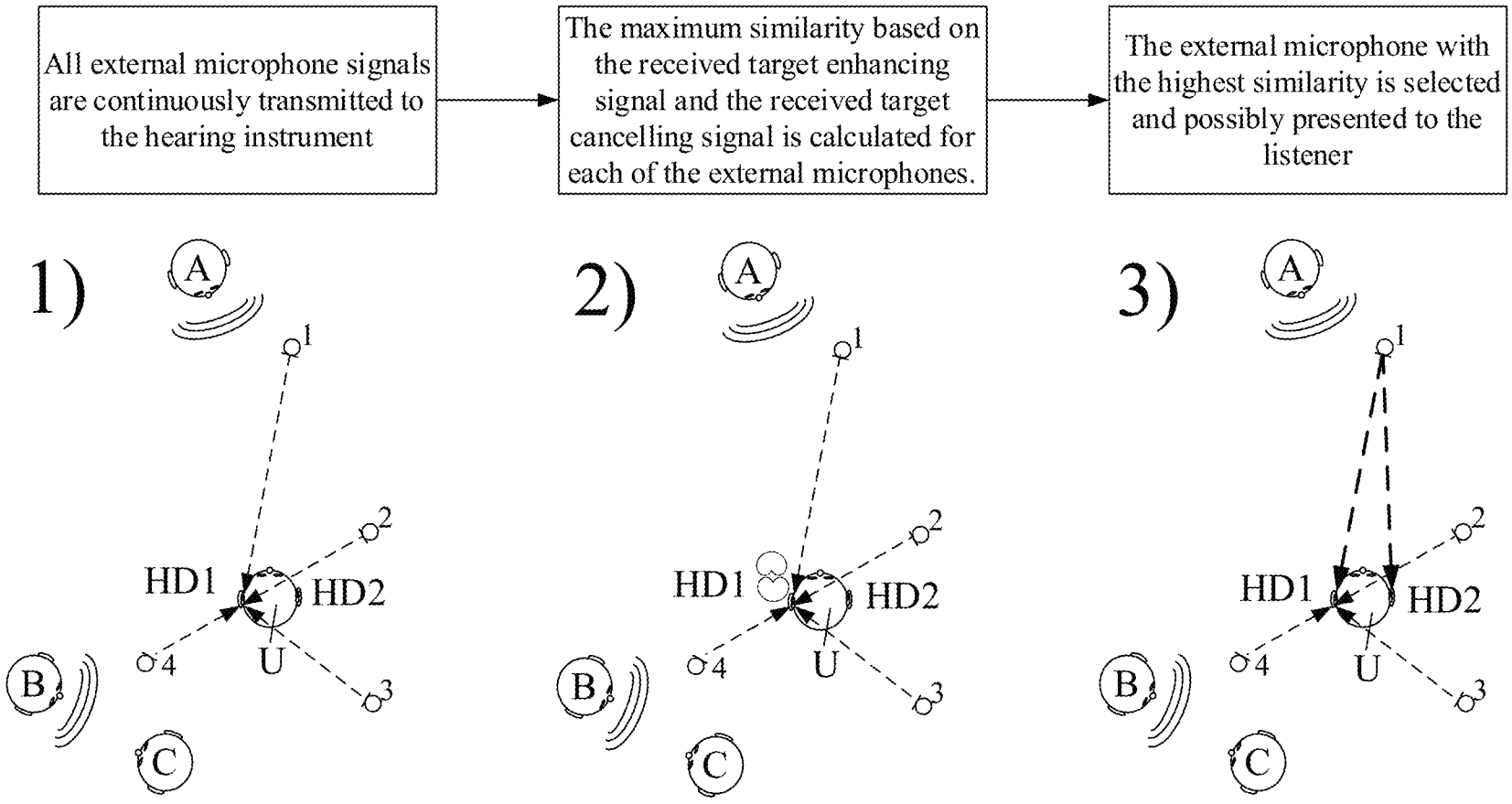
FIG. 6 shows an embodiment a method of operating of a hearing system according to the present disclosure, wherein, contrary to FIG. 2 or 3, all calculations may take place in the user's hearing instrument.

FIG. 6 shows an embodiment a method of operating of a hearing system according to the present disclosure, wherein, contrary to FIG. 2 or 3, all calculations may take place in the user's hearing instrument. This requires that all external microphone signals are (at least partly) transmitted to the hearing instrument 1). The similarity to each external microphone signal is calculated in the hearing instrument 2), and the microphone signal with the highest similarity (microphone 2) is presented to the listener 3). In case a signal from a target cancelling beamformer of the hearing instrument is used for comparison with the respective audio signals of the external microphone units, the signal exhibiting the smallest (absolute) correlation ($\rho(x_n, y_{tgtcncl})$) would be selected for presentation to the hearing instrument user. This may be advantageous, as the external microphone signals may serve as noisy reference signals even though they are not directly presented to the listener. In an embodiment only a low- or band-pass filtered external audio signal is transmitted to the hearing instrument for similarity comparison. Alternatively, not all time frames of the external microphone signals are transmitted. Only the selected external microphone signal to be presented to the listener are required to be transmitted with full framerate and bandwidth.

In another embodiment all similarity measures are exchanged between all external microphone units.

In one embodiment, the hearing instrument contains an own voice detector. In case of a detected own voice signal, the local microphones should be presented to the listener (e.g. the hearing instrument user) rather than any external microphone signal.

Switching between different external microphones or switching between the hearing instrument microphones and the external microphones should not be noticed by the listener. Preferably, the switching between different microphones may happen during speech pauses.

Figure 7:
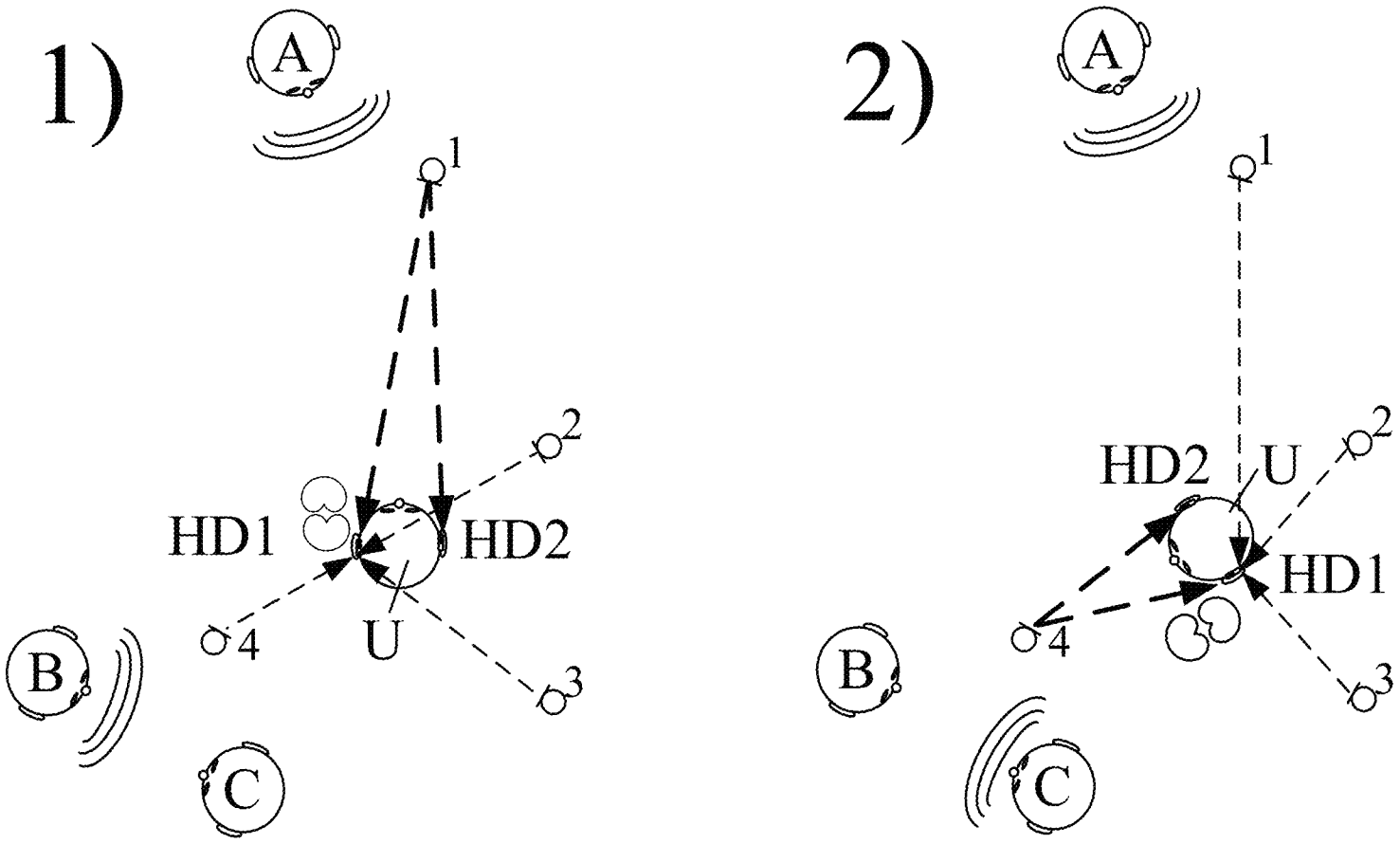
FIG. 7 shows an example of how the user by his head is able to select a talker of interest.

The selection of a particular external microphone unit as the source of the target sound signal may change over time as e.g. the user changes head direction, see FIG. 7. In an embodiment the similarity measure is calculated continuously, e.g. based on transmitted audio signals with a transmission rate of e.g. 50 times per second, also other transmission rates may be utilized, e.g. 100 times per second or 10 times per second or once per second. The transmission rate of the different external microphones may be different. In an embodiment the transmission/calculation rate is increased if a head movement is detected.

FIG. 7 shows an example of how the user by his head is able to select a talker of interest. In the left part of FIG. 7 (denoted '1)'), the listener is looking towards the direction of talker A, while talker B is talking at the same time. In this situation, as the target enhancing beamformer of the (here left) hearing instrument (HD1) mainly contains sound from talker A, and the target cancelling beamformer mainly attenuates talker A, the similarity measure will indicate that the signals of microphone 1 should be presented to the listener. In the right part of FIG. 7 (denoted '2)'), the listener (U) has turned his head towards the conversation between talker B and C. In this case the target enhancing beamformer mainly contains talker C (and B), and the target cancelling beamformer attenuates talker C (and B). In this case, the similarity measure will indicate that the signal from microphone 4 should be presented to the listener.

In an embodiment, each of (or at least one of the microphone units comprise a voice activity detector, providing an indication of whether or not, or with what probability, a current signal picked up by the microphone(s) of the microphone unit contains speech. Thereby calculation of similarity measures (coefficients) in a given microphone unit may be restricted to times where speech is detected by the voice activity detector of the microphone unit. If no speech is detected, the similarity measure may be set to a value '0' (indicating no or low similarity).

Figure 8:
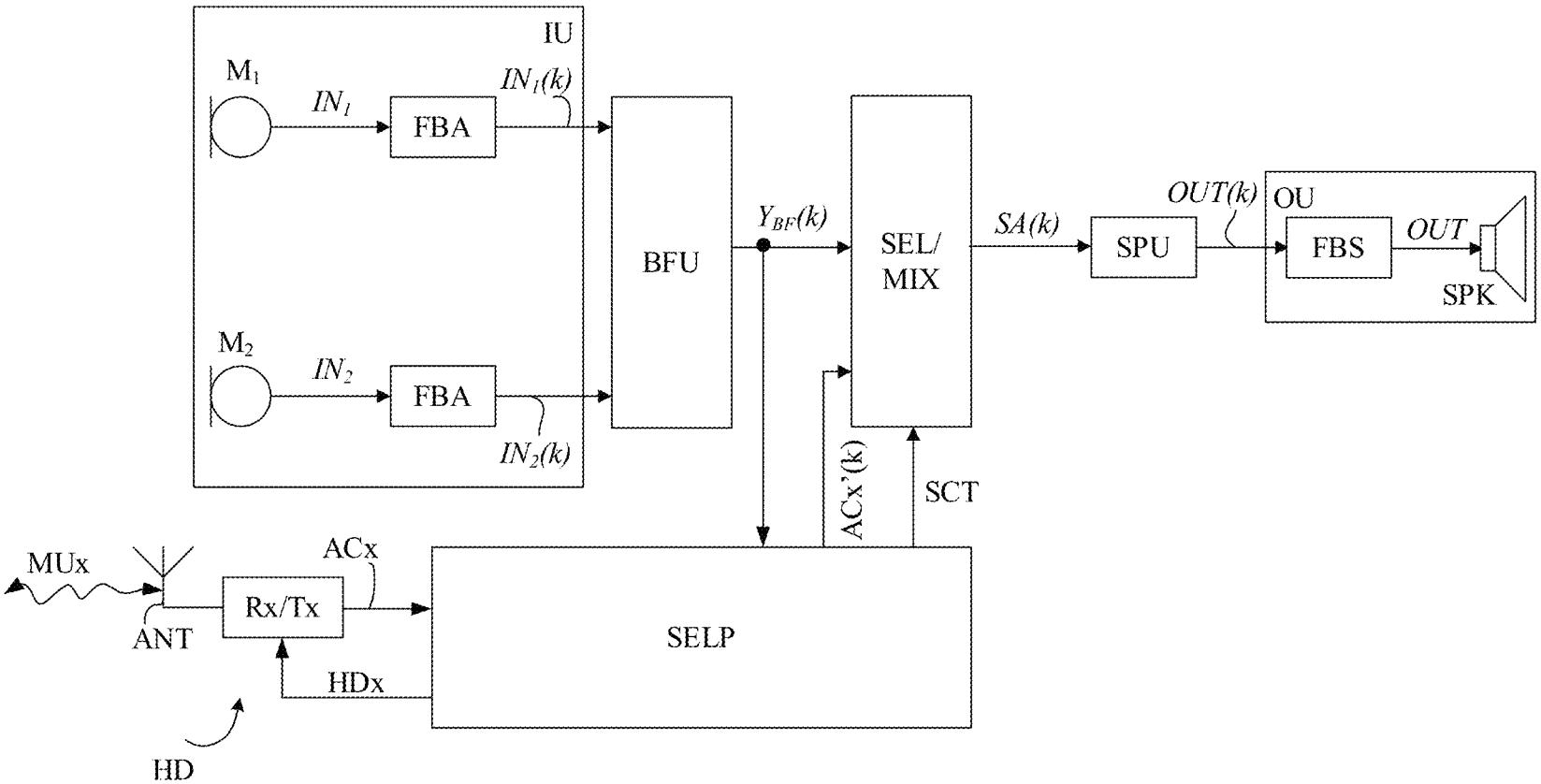
FIG. 8 shows an embodiment of a hearing device according to the present disclosure.

FIG. 8 shows an embodiment of a hearing device according to the present disclosure. The hearing device (HD), e.g. a hearing aid, may e.g. be adapted for being worn by (and/or implanted in) a user. The hearing device comprises an input unit (IU) comprising a multitude of microphones (here two microphones (M1, M2)). Each microphone (M1, M2) provides an electric input signal ($IN_1$, $IN_2$, respectively) representative of the sound field around the user wearing the hearing device. The input unit (IU) further comprises respective analysis filter banks (FBA) for providing the electric input signals in a time-frequency representation (as frequency sub-band signals ($IN_1(k)$, $IN_2(k)$, k=1, . . . , K). The hearing device (HD) further comprises a beamformer filter (BFU) (or directional system, cf. DIR in FIG. 10) providing a beamformed signal $Y_{BF}(k)$ from the multitude of electric input signals ($IN_1(k)$, $IN_2(k)$). The hearing device further comprises a selector-mixer (SEL/MIX) selecting an appropriate wirelessly received signal ACx'(k) from an external microphone unit according to the current interest of the user. The hearing device (HD) comprises a wireless transceiver (ANT, Rx/Tx) for wirelessly receiving (and demodulating, etc.) information and/or audio data (ACx) from other devices, e.g. audio transmitters. The appropriate wirelessly received signal ACx'(k) may e.g. be determined by the selection processor (SELP), e.g. based on a correlation measure indicative of a correlation between the beamformed signal $Y_{BF}(k)$ and the wirelessly received signal ACx. The selected wirelessly received signal ACx'(k) may e.g. be mixed (in the selector-mixer (SEL/MIX)) with the beamformed signal YBF(k) to provide a resulting mixed signal SA(k), e.g. controlled by selection control signal SCT from the selection processor (SELP). Before mixing, appropriate alignment (time delay, and/or gain (attenuation or amplification)) may be applied to the respective input audio signals (e.g. based on a correlation measurement). The hearing device (HD) further comprises a signal processor (SPU) configured to further adapt the signal SA(k) to the needs of a user, e.g. to apply a frequency and level dependent gain (amplification or attenuation) according to the user's hearing impairment (e.g. based on data representative of a hearing threshold versus frequency, e.g. an audiogram). The signal processor (SPU) provides a processed output signal OUT(k). The hearing device (HD) further comprises an output unit (OU) configured to provide stimuli perceivable by the user as sound. The output unit (OU) of the embodiment of a hearing device of FIG. 8 comprises a synthesis filter bank (FBS) for converting the frequency sub-band signals OUT (k) to a signal OUT in the time domain, and a loudspeaker (SPK) for converting the processed output signal OUT to acoustic stimuli for presentation to the user. The output unit (OU) may comprise a digital to analogue converter as the case may be. Likewise, on the input side, appropriate analogue to digital converters may be applied.

The wireless transceiver (ANT, Rx/Tx) may be configured to (modulate, encode, etc., and) wirelessly transmit information and/or audio data (HDx) from the hearing device to other devices, e.g. audio transmitters (e.g. microphone units) or associated processing units, e.g. for evaluating a degree of similarity between an audio signal picked up by the hearing device and an audio signal picked up by an external audio transmitter, e.g. a microphone unit.

The selection processor (SELP) is configured to compare the beamformed signal $Y_{BF}$ with respective audio signals from the currently available audio transmitters (or with bandlimited, or down-sampled versions thereof). The selection processor (SELP) is configured to select the one or more of the currently available audio signals according to a selection criterion, e.g. the one(s) exhibiting the highest correlation measure(s), and to issue a transmission request to the audio transmitter(s) in question, and to subsequently receive the audio signal(s) of current interest to the user in the hearing device and presenting the audio signal(s) to the user, possibly as a mixture with an audio signal picked up by a microphone or microphones of the hearing device (e.g. the beamformed signal, e.g. appropriately aligned in time with the wirelessly received signal(s) to avoid artifacts/distortion).

The hearing device of FIG. 8 may e.g. be used in connection with a multitude of external, spatially separated audio transmitters, e.g. microphone units (cf. e.g. units 1, 2, 3, 4, in FIG. 1-3, 6, 7). The audio transmitters, e.g. microphone units, are individual devices or form part of respective separate electronic devices, e.g. communication devices (e.g. smartphones), or form part of another hearing device, each being configured to pick up sound from a sound field surrounding the hearing device (HD) (but preferably providing sound from one or more sound sources in a better quality than what is received acoustically by the microphones of the hearing device (HD)). One or more of the audio transmitters may be configured to transmit sound that is simultaneously provided as acoustic signals, but which is not necessarily representative of sound from the immediate environment of the user. Such audio transmitters may e.g. transmit sound from a TV or other entertainment device, or any other device comprising a loudspeaker and an audio transmitter.

The hearing system comprising the hearing device (HD) and the audio transmitters are configured to allow wireless communication, including audio communication, between the hearing device and the audio transmitters (e.g. external microphone units), at least from the audio transmitters (e.g. microphone units) to the hearing device (HD), e.g. a hearing aid.

Figure 9A:
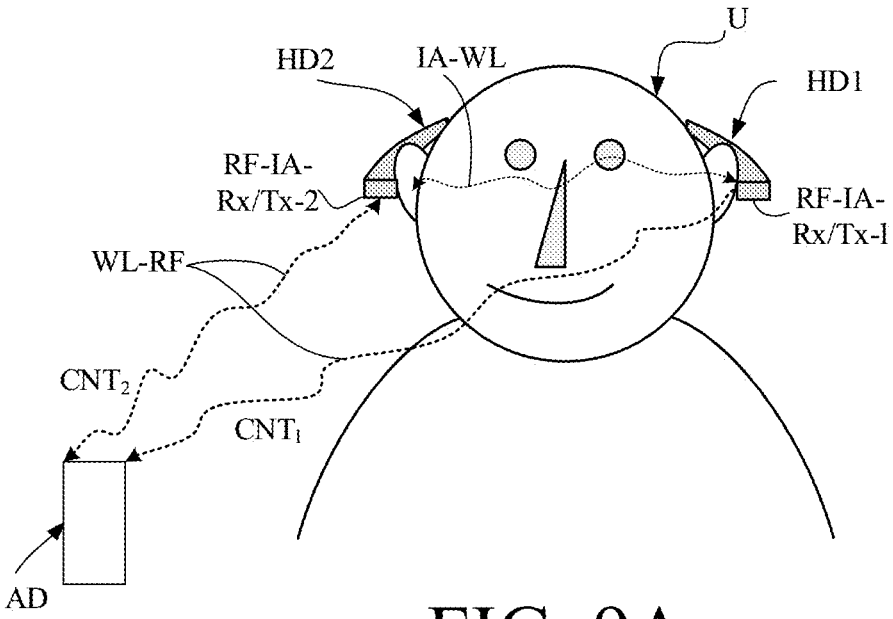
FIG. 9A shows an embodiment of a hearing system, e.g. a binaural hearing aid system, according to the present disclosure.
Figure 9B:
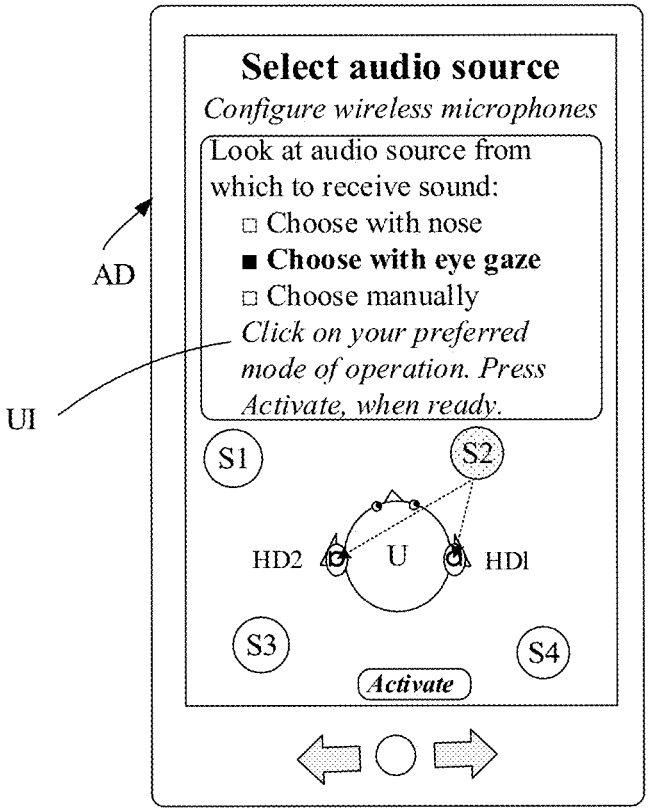
FIG. 9B illustrates an auxiliary device configured to execute an APP implementing a user interface of the hearing device or system from which a mode of operation and an active sound source can be selected.

FIG. 9A illustrates an embodiment of a hearing system, e.g. a binaural hearing aid system, according to the present disclosure. The hearing system comprises left and right hearing devices in communication with an auxiliary device, e.g. a remote control device, e.g. a communication device, such as a cellular telephone or similar device capable of establishing a communication link to one or both of the left and right hearing devices. FIG. 9B illustrates an auxiliary device configured to execute an application program (APP) implementing a user interface of the hearing device or system from which a mode of operation for selecting of wireless reception of sound from an active sound source can be selected and/or configured.

FIG. 9A, 9B together illustrate an application scenario comprising an embodiment of a binaural hearing aid system comprising first (left) and second (right) hearing devices (HD1, HD2) and an auxiliary device (AD) according to the present disclosure. The auxiliary device (AD) comprises a cellular telephone, e.g. a SmartPhone. In the embodiment of FIG. 9A, the hearing devices and the auxiliary device are configured to establish wireless links (WL-RF) between them, e.g. in the form of digital transmission links according to the Bluetooth standard (e.g. Bluetooth Low Energy, or equivalent technology). The links may alternatively be implemented in any other convenient wireless and/or wired manner, and according to any appropriate modulation type or transmission standard, possibly different for different audio sources. The auxiliary device (e.g. a SmartPhone) of FIG. 9A, 9B comprises a user interface (UI) providing the function of a remote control of the hearing aid system, e.g. for changing program or mode of operation or operating parameters (e.g. volume) in the hearing device(s), etc. The user interface (UI) of FIG. 9B illustrates an APP (denoted 'Select audio source' ('Configure wireless reception')) for selecting a mode of operation of the hearing system or device where a currently active sound source is to be selected, either by directing the nose towards the sound source (option 'Choose with nose'), or by using eye gaze ('Choose with eye gaze'), or by manually selecting the sound source of interest ('Choose manually') via the graphical user interface (see sketch with user (U) and geometrical distribution of active sound sources (S1-S4) in the lower part of the screen of FIG. 9B). In the screen of FIG. 9B, the 'Choose with eye gaze' mode of operation has been selected as indicated by the left solid 'tick-box' and the bold face indication 'Choose with eye gaze' (and in the sketch by Sound source S2 being grey shaded selected by the user's eye gaze towards source S2). The control of functionality in a hearing device using eye gaze is e.g. discussed in US20170180882A1.

In an embodiment, at least some of the calculations related to source selection (e.g. detection of which of the active sound sources correlate best with a current (assumed) intention of the user; i.e. with the (possibly beamformed) sound signal received by the microphones of the hearing devices worn by the user) are performed in the auxiliary device. In another embodiment, the calculations are fully or partially performed in the left and/or right hearing devices. In the latter case the system may be configured to exchange the data between the auxiliary device and the hearing device(s). The hearing device (HD1, HD2) are shown in FIG. 9A as devices mounted at the ear (behind the ear) of a user (U). Other styles may be used, e.g. located completely in the ear (e.g. in the ear canal), fully or partly implanted in the head, etc. As indicated in FIG. 9A, each of the hearing instruments may comprise a wireless transceiver to establish an interaural wireless link (IA-WL) between the hearing devices, e.g. based on inductive communication or RF communication (e.g. Bluetooth technology). Each of the hearing devices further comprises a transceiver for establishing a wireless link (WL-RF, e.g. based on radiated fields (RF)) to the auxiliary device (AD), at least for receiving and/or transmitting signals, e.g. control signals, e.g. information signals, e.g. correlation estimates, e.g. including audio signals. The transceivers are indicated by RF-IA-Rx/Tx-1 and RF-IA-Rx/Tx-2 in the right (HD2) and left (HD1) hearing devices, respectively.

Figure 10:
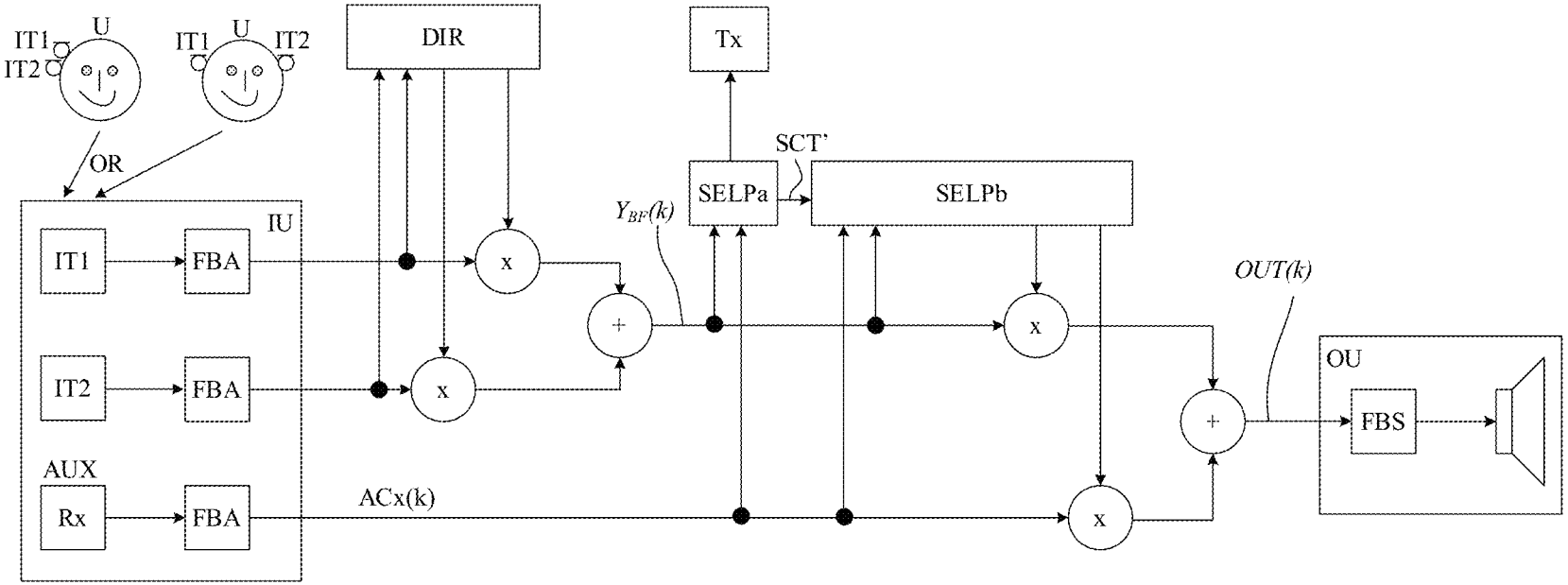
FIG. 10 shows an embodiment of a hearing device or a hearing system according to the present disclosure.

FIG. 10 shows an embodiment of a hearing aid or a hearing aid system according to the present disclosure. The embodiment of FIG. 10 is similar to the embodiment of FIG. 8. It comprises the same functional elements as the embodiment of FIG. 8, but the processing units of the forward path from input unit (IU) to the output unit (OU) comprise combination units ('+', 'X') in the forward path itself to combine signals ('+') or to apply appropriate gains to signals ('X') AND respective processing units (DIR, COMP) in parallel with the forward path to determine appropriate gains applied to signals of the forward path by the multiplication units ('X'). The difference reflects different appropriate implementations, which may depend on the application in question.

The selection processor (SELP) of the embodiment of FIG. 10 receives the beamformed signal $Y_{BF}$ (representative of a signal of current interest to the user as picked up the microphones (M1, M2) of the hearing device and spatially filtered by the directional system (DIR, see equivalent BFU in FIG. 8). The selection processor (SELP) further receives the wirelessly received signal ACx on the AUX-channel. The two signals may both be provided to the selection processor as frequency sub-band signals (indicated by index k, k=1, . . . , K; K may e.g. be in the range from 2 to 128). However, the wirelessly received signal ACx may e.g. be received (and/or analysed) in a fewer number of frequency channels than K (of the forward path), and/or down-sampled to minimize the processing power during identification of the sound source of current interest to the user. The down-sampling and or reduction to fewer channels for comparison with the beamformed signal of the forward path may e.g. be performed in the selection processor (SELPa). A transmission request to one or more of the currently active audio transmitters (cf. e.g. microphone units 1, 2, 3, 4 in FIG. 1,2,3, 6, 7) around the hearing device may be issued by the selection processor (SELPa) and transmitted by the transmitter (Tx) to the audio transmitters. A scanning process may thus be initiated by the selection processor (SELPa) and, when signals from all available (relevant) transmitters have been compared with the beamformed signal (e.g. using a correlation measure), the signal that is determined to be of the user's current interest (largest correlation measure) can be requested from the audio transmitter in question (and e.g. processed in full audio quality by the hearing device). When the signal of current interest to the user has been decided on, e.g. indicated by the control signal SCT' from selection processor part SELPa to SELPb, the beamformed signal $Y_{BF}$ and the wirelessly received signal ACx are analysed by the selection processor (SELPb) and an appropriate mutual weighting of the two signals (and possible alignment and/or frequency and level dependent shaping of one or both) may be determined and applied to the signals in the selection processor and/or via respective multiplication units '(X'). A combination unit ('+') sums the two weighted signals and provides a resulting output signal OUT(k), which is fed to the output unit for presentation to a user as described in connection with FIG. 8. In an embodiment, none of the wirelessly received signals ACx are selected for presentation to the user. This can e.g. be of interest in situations, where the signal picked up the input transducers of the hearing device (e.g. the beamformed signal $Y_{BF}$) is of a higher quality (e.g. SNR) than any of the wirelessly received signals from the audio transmitters. In such case, only the locally picked up signal, e.g. $Y_{BF}$, may be presented to the user. The hearing device (e.g. the selection processor) may comprise appropriate memory units to facilitate alignment of signals and other processes of the hearing device.

The process for determining a sound source of current interest to the user may be to configure the system to provide access to all external microphone signals at the same time. By constantly analysing these signals a decision can be made on which signal(s) is(are) most relevant to present to the user. The decision can be based on a comparison of the levels of the signals, their modulation characteristics, an estimate of diffuseness or reverberation and/or the level of broadband background noise in each channel. The analysis can be done taking both the microphone signals, and the wirelessly received signals into account. For example, the target source signal which is most energetic in the microphone signal may be determined by using individual, wirelessly received, target signals when analysing the microphone signals. The most energetic target signal often originates from the target speaker which is closest to the hearing aid user (assuming here that physical proximity correlates with relevance). In an embodiment, an appropriate 'soft mixture' of signals is presented to the user, e.g. based on a linear combination of the available input signals. The weights of the linear combination may e.g. be dependent on the degree of similarity of the individual signals from the external microphone units with a signal received by the microphone(s) of the hearing device.

The two illustrations in the top left corner of FIG. 10 is intended to indicate that the two input transducers IT1 and IT2 may be located at the same ear or at opposite ears of the user (U). In case the input transducers are located at opposite ears ((right illustration) e.g. in contralateral hearing aids of a binaural hearing aid system), the input transducer, e.g. IT2, representing the input transducer of an opposite ear comprises appropriate receiver circuitry for wirelessly receiving the signal (e.g. a microphone signal) from the other hearing aid. In such case appropriate circuitry for compensating for processing delay of the transmitted signal may be included, e.g. in the analysis filter bank or in the directional system.

The hearing device (HD) comprises a wireless receiver (Rx) for receiving information or audio data from another device via an AUX channel. The other (transmitting) device may e.g. be an external audio transmitter, e.g. a microphone unit or a processing unit, in the environment of the hearing device. External audio transmitters, e.g. microphone units, may connect to the aux channel either through digital (e.g. Bluetooth or the like) or analogue (e.g. FM) transmission. The wireless receiver (Rx) (and the input transducers (IT1, IT2)) may comprise analogue to digital conversion capability as appropriate.

The hearing devices shown in FIGS. 8 and 10 may e.g. be used in a scenario, where several microphone units (here three, MU1, MU2, MU3) share the same transmission channel, i.e. only one signal can be input to the hearing devices (HD1, HD2) at a time. In such case it should be agreed among the active microphone units which one is to transmit/receive at a given point in time, e.g. by a scanning and correlation procedure as described above, e.g. where a user's nose or eye gaze (look direction) determines a current sound source of interest. This situation is shown in FIG. 11, where at time A (left part of FIG. 11), the user (U) looks at talker T1 (cf. dotted arrow denoted LD1 indicating a look direction of the user towards T1) and receives (after an appropriate scanning procedure) a wireless signal picked up by a microphone unit (MU1) worn by talker T1, and at time B (right part of FIG. 11), the user (U) looks at talker T2 (cf. dotted arrow denoted LD2) and receives (after an appropriate scanning procedure) a wireless signal picked up by microphone unit (MU2) worn by talker T2.

Figure 11:
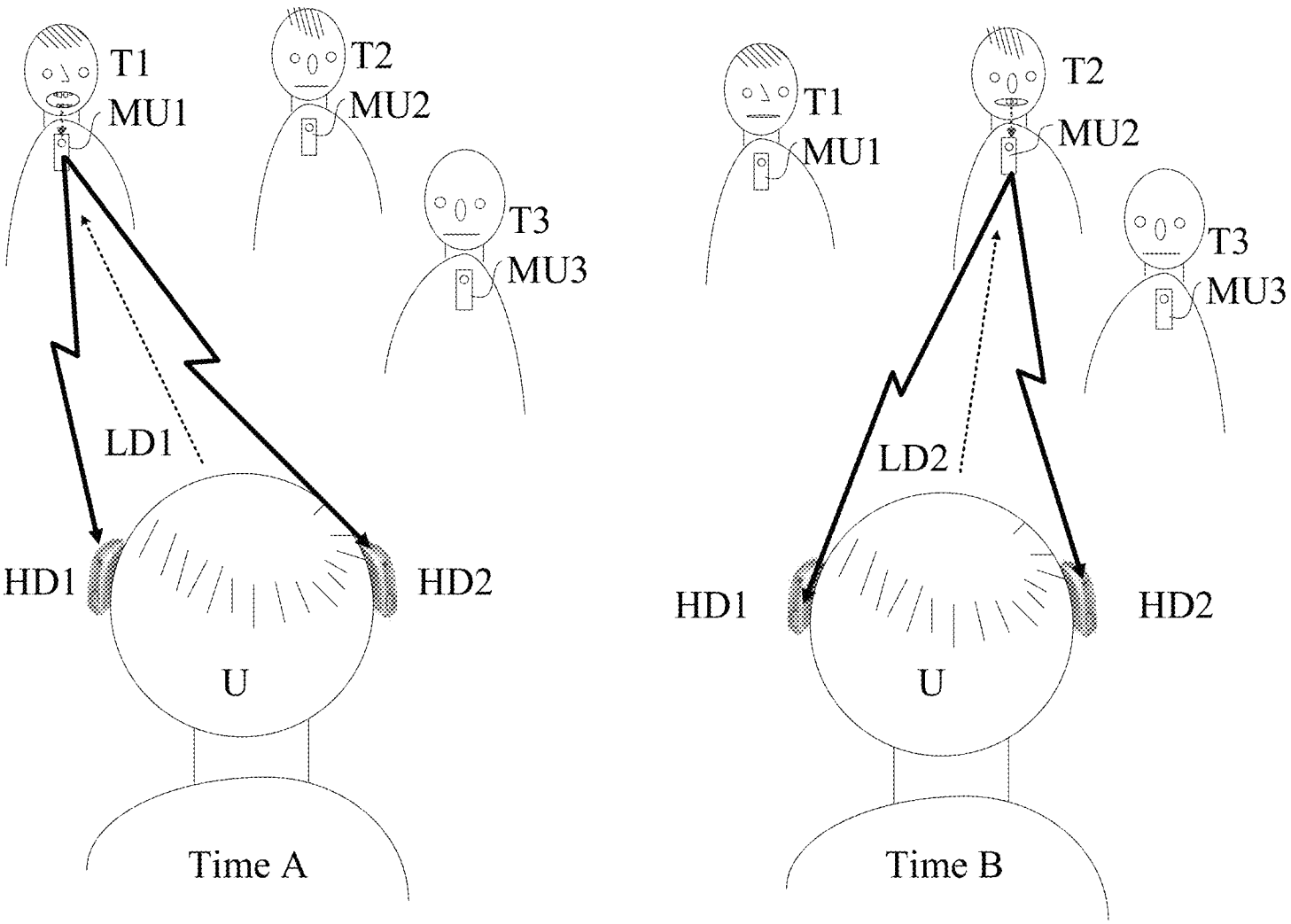
FIG. 11 shows an example of a scenario where several remote microphones have to share the same communication channel.

One way to implement a scenario as shown in FIG. 11 is to, once in a while, exchange metadata about each microphone. Such metadata could e.g. be the sound pressure level at each microphone or it could also be information such as the amount of modulation (e.g. provided by a voice activity detector) in each microphone signal or a bandlimited or down-sampled version of each microphone signal, or a combination of such measures. This metadata only occupies the transmission channel for a short while. The received data can be compared, either amongst the microphones or at the hearing devices, and based on the comparison, it can be decided from which microphone to send/receive the audio data. This of course requires that each microphone unit is able to transmit as well as to receive signals. Hysteresis may be built into the transmission decision in order to avoid that the audio data switch (unintentionally, too fast) between the microphone units. This processing scheme is illustrated in FIG. 12.

Figure 12:
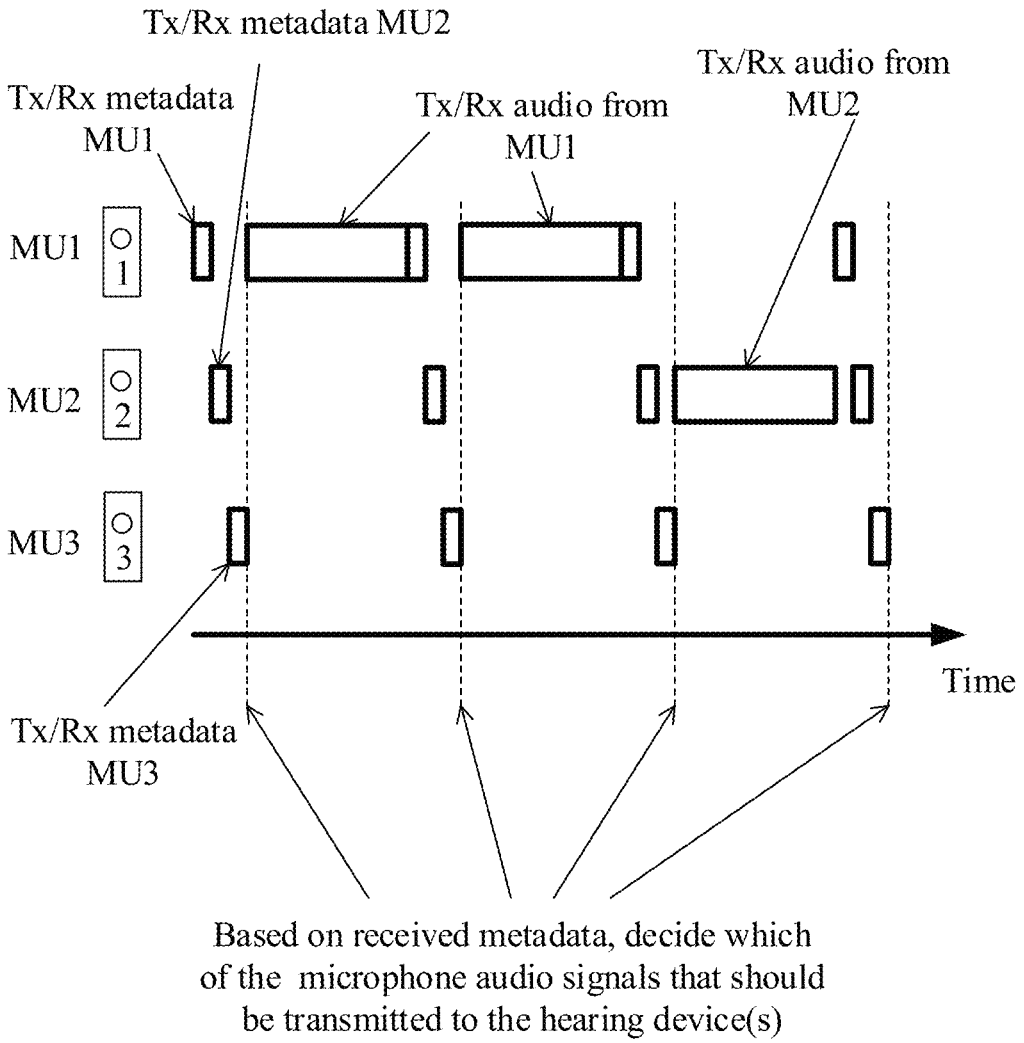
FIG. 12 illustrates the scenario of FIG. 11 where several remote microphone units have to share the same communication channel, and where metadata are exchanged between all the microphone units in order to decide which of the audio signals should be transmitted to the hearing device(s).

FIG. 12 shows an example of the scenario of FIG. 11 where several remote microphone units have to share the same communication channel. Metadata (which only occupies a small amount of time compared to audio data) are exchanged between all the microphones in order to decide which of the microphone audio signals should be transmitted to the hearing instruments at a given point in time. In the example above, it is decided to transmit audio data from microphone unit 1 (MU1) in the first and second audio data blocks. For the third data block it is decided to transmit the audio data from the second microphone unit (MU2).

In general, the decision of a degree of similarity between signals received by the hearing device and picked up and/or transmitted by the audio transmitters may be based on microphone signals at one (monaural) or both (binaural) ears of the user. Spatial 'binauralization' is e.g. discussed in patent applications by Mojtaba et al. (e.g. US20180262849A1, or EP3285500A1).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

US20170180882A1 (Oticon) 22.06.2017
US20180262849A1 (Oticon) 13.09.2018
EP3285500A1 (Oticon) 21.02.2018
US2013094683A1 (Oticon) 18.04.2013

The invention claimed is:

1. A hearing system comprising at least one hearing device adapted for being worn on the head, or fully or partially implanted in the head, of a user, and a multitude of external, spatially separated, audio transmitters, each providing respective external electric sound signals comprising audio;

the hearing system being configured to allow wireless communication, including audio communication, between said hearing device and said external audio transmitters, at least from said external audio transmitters to said at least one hearing device, to be established;

the at least one hearing device comprising a multitude of microphones, each providing an electric input signal representative of sound;

a beamformer filter providing a beamformed signal from said multitude of electric input signals; and an output unit configured to provide stimuli perceivable by the user as sound, wherein the hearing system further comprises a selector/mixer for selecting and possibly mixing one or more of said electric input signals or said beamformed signal from the hearing device and said external electric signals from the audio transmitters and to provide a current input sound signal based thereon intended for being presented to the user, possibly in a further processed form, the selector/mixer being controlled by a source selection control signal provided by a source selection processor configured to determine said source selection control signal in dependence of a comparison of said beamformed signal and said external electric sound signals or processed versions thereof, and a mixing ratio between the electric input signals or the beamformed signal and the external electric sound signals is determined in dependence of a comparison of the beamformed signal with the external electric sound signals or processed versions thereof.

2. A hearing system according to claim 1 wherein said source selection control signal is determined based on a comparison of filtered or down-sampled versions of the beamformed signal with filtered or down-sampled versions of said multitude of external electric sound signals.

3. A hearing system according to claim 1 wherein said source selection control signal is determined based on a comparison of parameters derived from said beamformed signal with corresponding parameters derived from said multitude of external electric sound signals.

4. A hearing system according to claim 3 wherein said parameters comprise one or more of a signal-to-noise measure, a modulation measure, a level measure.

5. A hearing system according to claim 1 configured to provide that said comparison is performed in the respective audio transmitters, and wherein a similarity measure indicative of the degree of similarity of the beamformed signal with the respective external electric sound signals or processed versions thereof is determined in said audio transmitters.

6. A hearing system according to claim 5 configured to provide that said similarity measures are transmitted from said multitude of audio transmitters to said at least one hearing device or to a processing device in communication with the hearing device.

7. A hearing system according to claim 1 configured to provide that said comparison is performed in the at least one hearing device, and wherein respective similarity measures indicative of the degree of similarity of the beamformed signal or a processed version thereof with the respective external electric sound signals or correspondingly processed versions thereof are determined in said at least one hearing device.

8. A hearing system according to claim 7 wherein said beamformed signal is a target enhancing beamformer signal configured to enhance a target signal relative to other signals.

9. A hearing system according to claim 7 configured to provide that the at least one hearing device receives the external electric sound signal from the audio transmitter having the largest similarity measure among the multitude of audio transmitters and to present it to the user via the output unit.

10. A hearing system according to claim 7 wherein said beamformed signal is a target cancelling beamformer signal configured to cancel a target signal and wherein the hearing system is configured to provide that the at least one hearing device receives the external electric sound signal from the audio transmitter having the smallest similarity measure among the multitude of audio transmitters and to present it to the user via the output unit.

11. A hearing system according to claim 1 wherein the beamformed signal is presented to the user instead of one of the external sound signals, in case its quality is higher than any of the external electric sound signals.

12. A hearing system according to claim 1 wherein said output unit for providing a stimulus perceived by the user as an acoustic signal based on a processed electric signal comprises a number of electrodes of a cochlear implant (for a CI type hearing device) or a vibrator of a bone conducting hearing device.

13. A hearing system according to claim 1 configured to present the current input sound signal or a further processed version thereof to the user via the output unit.

14. A hearing system according to claim 1 wherein at least one of said multitude of audio transmitters comprise a microphone unit.

15. A hearing system according to claim 14 wherein said microphone unit comprises a multitude of microphones, each providing a microphone signal, and a beamformer filter, configured to provide a beamformed signal based on the microphone signals picked up by said multitude of microphones.

16. A hearing system according to claim 14 wherein said microphone unit comprises or form part of one or more of a wireless microphone unit, a mobile telephone, and a speakerphone.

17. A hearing system according to claim 1 wherein said at least one hearing device is constituted by or comprises a hearing aid, a headset, an earphone, an ear protection device or a combination thereof.

18. A hearing device adapted for being worn by a user, the hearing device comprising a multitude of microphones, each providing an electric input signal representative of a sound field surrounding said hearing device;

a beamformer filter providing a beamformed signal from said multitude of electric input signals; and an output unit configured to provide stimuli perceivable by the user as sound;

a wireless transceiver for receiving a signal comprising external electric sound signals from a multitude of external audio transmitters, possibly via a processing device, and for transmitting a signal comprising data to said multitude of audio transmitters, possibly via said processing device, a selector/mixer for selecting and possibly mixing one or more of said electric input signals or said beamformed signal from the hearing device and said external electric signals from the audio transmitters and to provide a current input sound signal based thereon intended for being presented to the user, possibly in a further processed form, the selector/mixer being controlled by a source selection control signal, a source selection processor configured to determine said source selection control signal in dependence of a comparison of said beamformed signal and said external electric sound signals or processed versions thereof, wherein a mixing ratio between the electric input signals or the beamformed signal and the external electric sound signals is determined in dependence of a comparison of the beamformed signal with the external electric sound signals or processed versions thereof.

19. A hearing device according to claim 18 being constituted by or comprising a hearing aid, a headset, an earphone, an ear protection device or a combination thereof.

20. A method of operating a hearing system comprising at least one hearing device adapted for being worn by a user, and a multitude of external, spatially separated, audio transmitters, said audio transmitters being individual devices or forming part of respective separate electronic devices, providing respective external electric sound signals, the method comprising providing a multitude of external electric sound signals from said multitude of audio transmitters;

providing wireless communication, including audio communication, between said at least one hearing device and said external audio transmitters, at least from said audio transmitters to said at least one hearing device;

providing a multitude of electric input signals, each being representative of a sound field at said at least one hearing device;

providing a beamformed signal from said multitude of electric input signals; and providing stimuli perceivable by the user as sound;

providing a source selection control signal in dependence of a comparison of said beamformed signal and said external electric sound signals or processed versions thereof; and selecting and possibly mixing one or more of said electric input signals or said beamformed signal from the hearing device and said external electric signals from the audio transmitters to thereby provide a current input sound signal based thereon in dependence of said source selection control signal, said current input signal being intended for presentation to the user, possibly in a further processed form, wherein a mixing ratio between the electric input signals or the beamformed signal and the external electric sound signals is determined in dependence of a comparison of the beamformed signal with the external electric sound signals or processed versions thereof.

* * * * *